US008226379B2

(12) United States Patent
Furuta et al.

(10) Patent No.: US 8,226,379 B2
(45) Date of Patent: Jul. 24, 2012

(54) HYDRAULIC PUMP

(75) Inventors: Katsunori Furuta, Obu (JP); Kaoru Oda, Toyokawa (JP); Yoshihito Suzuki, Toyokawa (JP); Moriyasu Gotoh, Toyohashi (JP); Hiroshi Inoue, Anjo (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 1130 days.

(21) Appl. No.: 12/057,847

(22) Filed: Mar. 28, 2008

(65) Prior Publication Data

US 2008/0237518 A1 Oct. 2, 2008

(30) Foreign Application Priority Data

Mar. 29, 2007 (JP) ..... 2007-086746
Mar. 30, 2007 (JP) ..... 2007-090949
Aug. 22, 2007 (JP) ..... 2007-215585

(51) Int. Cl.
*F04B 49/00* (2006.01)

(52) U.S. Cl. ..... 417/295; 417/298; 417/446; 417/505

(58) Field of Classification Search ..... 417/298, 417/446, 470, 568
See application file for complete search history.

(56) References Cited

U.S. PATENT DOCUMENTS 1,640,742 A * 8/1927 Wallace et al. ..... 310/34
6,457,957 B1 * 10/2002 Bauer et al. ..... 417/562
6,631,706 B1 * 10/2003 Yamada et al. ..... 123/495
7,717,089 B2 * 5/2010 Oda et al. ..... 123/506
2002/0009373 A1 1/2002 Ruthardt et al.
2004/0055580 A1 3/2004 Yamada et al.
2006/0222518 A1 * 10/2006 Oda et al. ..... 417/298

FOREIGN PATENT DOCUMENTS

JP B-2551174 8/1991
JP 2001-295720 10/2001
JP 2004-197834 7/2004
JP 2004-218633 8/2004
JP A-2004-360675 12/2004

OTHER PUBLICATIONS

Japanese Office Action dated Nov. 10, 2008 issued in corresponding Japanese Application No. 2007-090949 with English translation.
Chinese Office Action dated Aug. 18, 2010 issue in corresponding Chinese Application No. 200810087498.4 with English Translation.
Japanese Office Action dated Dec. 17, 2008 issued in Japanese Application No. 2007-215585, with English translation.
Chinese Office Action dated Jan. 19, 2012, issued in corresponding Chinese Application No. 200810087498.4 with English Translation.

* cited by examiner

*Primary Examiner* — Devon Kramer
*Assistant Examiner* — Ryan Gatzemeyer
(74) *Attorney, Agent, or Firm* — Nixon & Vanderhye PC

(57) ABSTRACT

A hydraulic pump includes a housing, a seat portion, and a valve element. The housing has a compression chamber and a fluid passage. The seat portion is provided midway through the fluid passage. The valve element is located between the compression chamber and the fluid passage. The valve element is a closed-end cylindrical member having a bottom portion, a cylindrical portion, and an opening end arranged in this order. The cylindrical portion is located farther away from the seat portion than the bottom portion. The valve element is seated to the seat portion at the bottom portion. A stopper substantially closes the opening end when making contact with the opening end to regulate movement of the valve element.

9 Claims, 14 Drawing Sheets

HYDRAULIC PUMP

CROSS REFERENCE TO RELATED APPLICATIONS

This application is based on and incorporates herein by reference Japanese Patent Applications No. 2007-86746 filed on Mar. 29, 2007, No. 2007-90949 filed on Mar. 30, 2007, and No. 2007-215585 filed on Aug. 22, 2007.

FIELD OF THE INVENTION

The present invention relates to a hydraulic pump.

BACKGROUND OF THE INVENTION

JP-A-2004-218633 discloses a high-pressure fuel pump including a plunger being movable to draw fuel into a compression chamber. The plunger is configured to pressurize the fuel in the compression chamber to pump the fuel. The high-pressure fuel pump includes a valve element, which is located between a fluid passage and the compression chamber for controlling flow of the fuel drawn into the compression chamber. The valve member is operated by a solenoid actuator. The solenoid actuator is configured to bias the valve element via a needle to lift the valve element from a valve seat portion. When the solenoid actuator is energized, the needle is moved toward a coil portion of the solenoid actuator. When the needle is moved, the valve element is not exerted with force from the needle. In this condition, the valve element is seated to the valve seat portion by being exerted with pressure of fuel in a compression chamber. Consequently, the valve element isolates the fluid passage from the compression chamber.

The high-pressure fuel pump in JP-A-2004-218633 includes a stopper, which is located farther away than the valve element with respect to the valve seat portion so as to regulate movement of the valve element. The stopper has a communication hole for communicating a compression chamber with an interior around the valve element. In the present structure, the stopper is applied with dynamic pressure of fuel when the fuel is returned from the compression chamber to a fluid passage through the valve seat portion. Consequently, the valve element needs to be exerted with large force to maintain the valve element lifted from the valve seat portion when fuel is returned from the compression chamber to a fuel chamber. In the present structure, the valve element needs to be exerted with large biasing force from a biasing member of the solenoid actuator. Accordingly, the biasing member and the solenoid actuator are increased in size.

According to US 2004/0055580 A1 (WO0047888), a high-pressure fuel pump includes a valve element, which is located between a fluid passage and a compression chamber for controlling flow of the fuel drawn into the compression chamber. The valve element is a bottomed cylindrical member accommodating a spring as a biasing member. The spring is axially resilient to bias the valve element toward a valve seat portion.

In the structure of US 2004/0055580 A1, the valve element has a cavity for accommodating the spring. The cavity of the valve element communicates with the compression chamber through a passage. Therefore, when the plunger moves upward to pressurize fuel in the compression chamber fuel in the cavity of the valve element needs to be pressurized. That is, fuel in the cavity of the valve element needs to be additionally pressurized, and consequently, efficiency of pumping fuel is impaired.

SUMMARY OF THE INVENTION

In view of the foregoing and other problems, it is an object of the present invention to produce a hydraulic pump having a valve element and a downsized solenoid actuator, which is for manipulating the valve element. It is another object of the present invention to produce a hydraulic pump enhanced in efficiency of pumping fluid.

According to one aspect of the present invention, a hydraulic pump comprises a housing having a compression chamber and a fluid passage. The hydraulic pump further comprises a seat portion provided midway through the fluid passage. The hydraulic pump further comprises a valve element located between the compression chamber and the fluid passage to control communication therebetween through a communication channel by being lifted from and seated to the seat portion, the communication channel being defined between the housing and an outer circumferential periphery of the valve element. The hydraulic pump further comprises a stopper configured to make contact with the valve element to regulate movement of the valve element in a direction opposite to the seat portion. The hydraulic pump further comprises a solenoid actuator provided upstream of the valve element with respect to fluid flow for manipulating the valve element by lifting the valve element from the seat portion. The valve element is a closed-end cylindrical member having a bottom portion, a cylindrical portion, and an opening end, the bottom portion and the opening end being located on opposite sides of the cylindrical portion, the bottom portion being configured to be seated to the seat portion, the cylindrical portion being located farther away from the seat portion than the bottom portion. The stopper is configured to make contact with the opening end to substantially close the opening end and regulate the movement of the valve element.

According to another aspect of the present invention, a hydraulic pump comprises a housing having a compression chamber and a fluid passage. The hydraulic pump further comprises a seat portion provided midway through the fluid passage. The hydraulic pump further comprises a valve element located between the compression chamber and the fluid passage to control communication therebetween through a communication channel by being lifted from and seated to the seat portion, the valve element being substantially a plate-shaped member. The hydraulic pump further comprises a solenoid actuator provided upstream of the valve element with respect to fluid flow for manipulating the valve element by lifting the valve element from the seat portion. The hydraulic pump further comprises a stopper configured to make contact with an end of the valve element to regulate movement of the valve element in a direction opposite to the seat portion. The communication channel is defined between the housing and an outer circumferential periphery of the stopper. The stopper is a closed-end cylindrical member having a bottom portion, a cylindrical portion, and an opening end, the bottom portion and the opening end being located on opposite sides of the cylindrical portion, the bottom portion being located farther away from the valve element than the cylindrical portion. The opening end is configured to make contact with the end of the valve element.

According to another aspect of the present invention, a hydraulic pump comprises a housing having a compression chamber and a fluid passage. The hydraulic pump further comprises a seat portion provided midway through the fluid passage. The hydraulic pump further comprises a valve element located between the compression chamber and the fluid passage to control communication therebetween through a communication channel by being lifted from and seated to the seat portion, the communication channel being defined between the housing and an outer circumferential periphery of the valve element, the valve element being a closed-end cylindrical member having a bottom portion, a cylindrical portion, and an opening end, the bottom portion and the opening end being located on opposite sides of the cylindrical portion, the bottom portion being configured to be seated to the seat portion, the cylindrical portion being located farther away from the seat portion than the bottom portion. The hydraulic pump further comprises a stopper configured to make contact with the opening end of the valve element to regulate movement of the valve element in a direction opposite to the seat portion. The hydraulic pump further comprises a resilient member accommodated in the valve element the resilient member being in contact with the bottom portion at one end and in contact with the stopper at an other end to bias the valve element toward the seat portion. The hydraulic pump further comprises a protrusion configured to be located inside the valve element to at least partially occupy an interior of the valve element.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
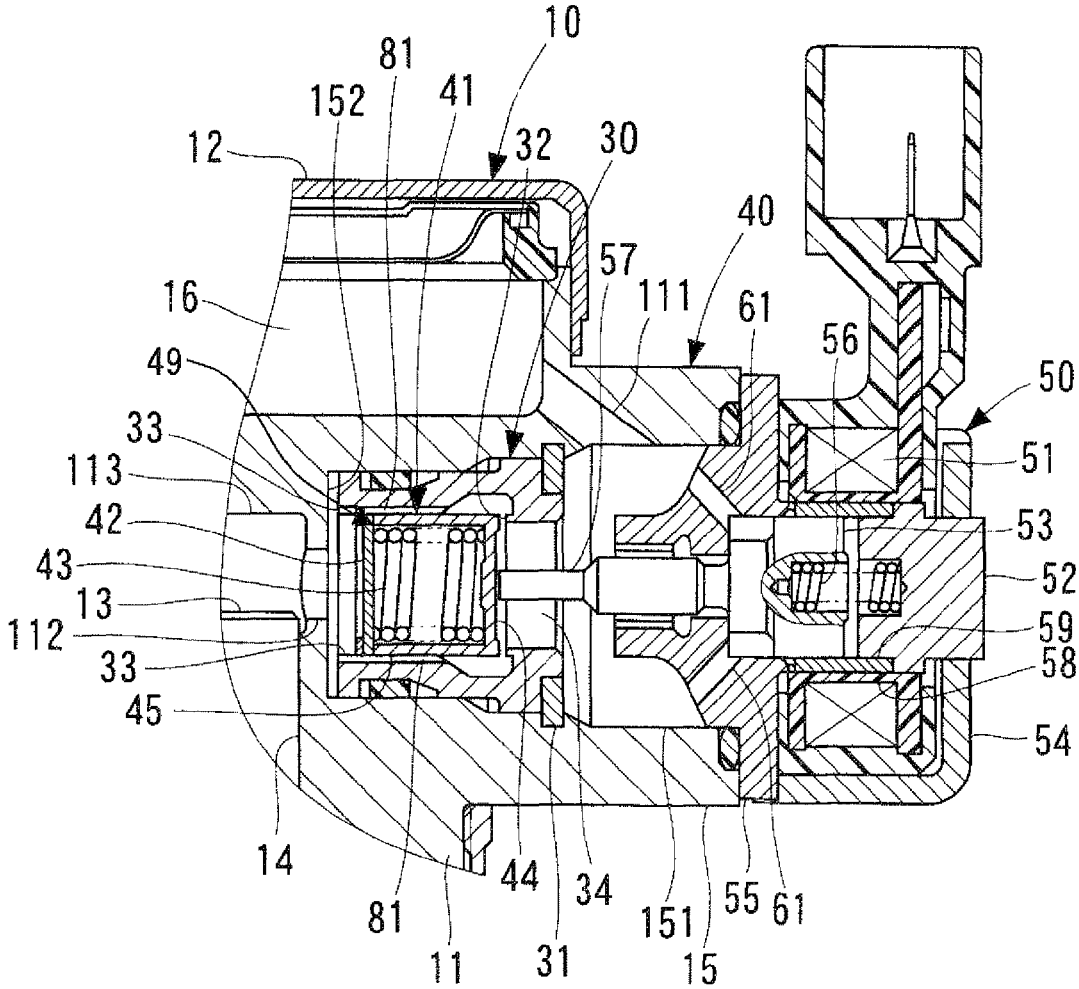
FIG. 1 is a sectional view showing a housing accommodating a metering valve portion of a hydraulic pump according to a first embodiment.
Figure 2:
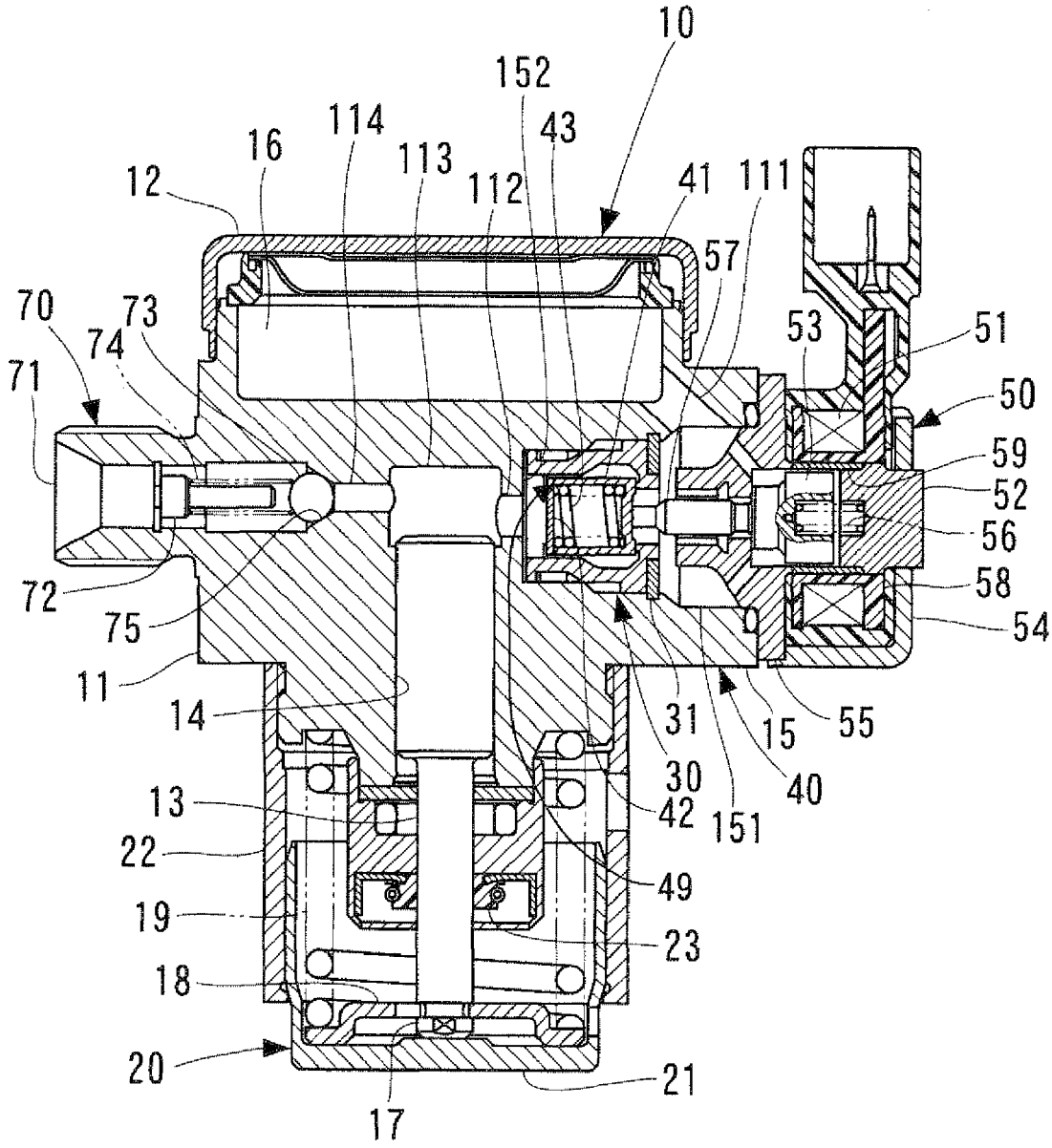
FIG. 2 is a sectional view showing the hydraulic pump according to the first embodiment.

As shown in FIGS. 1, 2, a high-pressure fuel pump 10 supplies fuel into an injector for an internal combustion engine such as a diesel engine or a gasoline engine.

As shown in FIG. 2, the high-pressure fuel pump 10 includes a housing body 11, a cover 12, a guide member 30, a plunger 13, a metering valve portion 40, a delivery valve portion 70, and the like. The housing body 11, the cover 12, and the guide member 30 construct a housing. The housing body 11 is formed from, for example, stainless steel such as martensitic stainless steel. The housing body 11 has a cylinder 14, which is substantially in a cylindrical shape. The plunger 13 is axially slidable in the cylinder 14 of the housing body 11.

The housing body 11 has an introduction passage 111, an inlet passage 112, a compression chamber 113, and a discharge passage 114. The housing body 11 has a cylindrical portion 15. The cylindrical portion 15 has a communicating portion 151, which communicates the introduction passage 111 with the inlet passage 112. The cylindrical portion 15 is substantially perpendicular to a center axis of the cylinder 14 and changes in inner diameter midway therethrough. The housing body 11 has a stepped surface 152 in which the cylindrical portion 15 changes in inner diameter. The communicating portion 151 of the cylindrical portion 15 is provided with the guide member 30.

The housing body 11 and the cover 12 therebetween define a fuel chamber 16. Fuel is supplied from a fuel tank (not shown) to the fuel chamber 16 using a low-pressure fuel pump (not shown). The introduction passage 111 communicates the fuel chamber 16 with the communicating portion 151, which is defined radially inside of the cylindrical portion 15. The inlet passage 112 has one end communicating with the compression chamber 113. The inlet passage 112 has the other end opened to the interior defined by the stepped surface 152. As shown in FIG. 1, the introduction passage 111 communicates with the inlet passage 112 through an interior of the guide member 30. Referring to FIG. 2, the compression chamber 113 communicates with the discharge passage 114 at the opposite side to the inlet passage 112.

The plunger 13 is axially slidably supported in the cylinder 14 of the housing body 11. The cylinder 14 has one end with respect to the movable direction of the plunger 13, and the one end of the cylinder 14 defines the compression chamber 113. A head 17 is provided to the other end of the plunger 13, and the head 17 is connected with a spring seat 18. A spring 19 is provided between the spring seat 18 and the housing body 11. The spring seat 18 is applied with biasing force of the spring 19 and biased onto the inner periphery of a bottom portion 21 of a tappet 20. The bottom portion 21 of the tappet 20 has an outer wall being in contact with a cam (not shown) and driven by the cam, whereby the plunger 13 axially moves. A tappet guide 22 defines a movement of the tappet 20. The tappet guide 22 is attached to the radially outside of the cylinder 14 of the housing body 11.

The spring 19 is in contact with the housing body 11 at one end. The spring 19 is in contact with the spring seat 18 at the other end. The spring 19 is configured to produce axial biasing force. In the present structure, the spring 19 applies the axial biasing force to the tappet 20 to bias the tappet 20 toward the cam via the spring seat 18. An outer circumferential periphery of the plunger 13 on the side of the head 17 and an inner circumferential periphery defining the cylinder 14 in the housing body 11 are therebetween liquid-tightly sealed with an oil seal 23. The oil seal 23 restricts intrusion of oil from the inside of the engine into the compression chamber 113. The oil seal 23 also restricts leakage of fuel from the compression chamber 113 into the engine.

The delivery valve portion 70 is provided on the side of the discharge passage 114 of the housing body 11. The delivery valve portion 70 defines a fuel outlet 71. The delivery valve portion 70 is configured to control discharge of fuel pressurized in the compression chamber 113. The delivery valve portion 70 includes a valve shaft member 72, a ball member 73, and a spring 74. The valve shaft member 72 is fixed to the housing body 11, which defines the discharge passage 114. The spring 74 is in contact with the valve shaft member 72 at one end. The spring 74 is in contact with the ball member 73 at the other end. The ball member 73 is applied with biasing force of the spring 74 and biased onto a valve seat 75 in the housing body 11. The ball member 73 closes the discharge passage 114 when being seated to the valve seat 75, and opens the discharge passage 114 when being lifted from the valve seat 75. When the ball member 73 moves away from the valve seat 75 and makes contact with an end of the valve shaft member 72, the ball member 73 is restricted from further moving.

As pressure of fuel in the compression chamber 113 increases, force exerted from the fuel in the compression chamber 113 to the ball member 73 increases. The ball member 73 is also exerted with the biasing force from the spring 74 and fuel in a delivery pipe (not shown) downstream of the valve seat 75. When the force exerted to the ball member 73 from the compression chamber 113 becomes greater than the sum of the biasing force applied from the spring 74 and force exerted from the downstream of the valve seat 75, the ball member 73 is lifted from the valve seat 75. As pressure of fuel in the compression chamber 113 decreases, force exerted from fuel in the compression chamber 113 to the ball member 73 decreases. When the force exerted to the ball member 73 from the compression chamber 113 becomes less than the sum of the biasing force applied from the spring 74 and force exerted from the downstream of the valve seat 75, the ball member 73 is seated to the valve seat 75. Thus, the delivery valve portion 70 operates as a check valve to intermit discharge of fuel from the compression chamber 113.

Referring to FIG. 1, the guide member 30 is fixed to the housing body 11. Specifically, the guide member 30 is fixed inside the communicating portion 151 by, for example, being press-inserted or being latched by a suspending member 31. The guide member 30 is substantially in a cylindrical shape. The guide member 30 has an end on the opposite side of the compression chamber 113, and the end of the guide member 30 defines a valve seat portion 32. The housing body 11 the cover 12, and the guide member 30 construct a housing.

The metering valve portion 40 includes a valve element 41, a stopper 42, a spring 43, and a solenoid actuator 50. The valve element 41 is axially movable in an inner circumferential periphery of the guide member 30. The valve element 41 is a closed-end cylindrical member including a bottom portion 44, a cylindrical portion 45, and an opening end 49. The cylindrical portion 45 has one end closed with the bottom portion 44. The cylindrical portion 45 has an outer wall, which is partially in contact with the inner circumferential periphery of the guide member 30. In the present structure, movement of the valve element 41 is guided by the guide member 30. The inner circumferential periphery of the guide member 30 partially defines a groove 33. The groove 33 of the guide member 30 defines a fuel communication channel 81, which is configured to communicate fuel on the outer circumferential periphery of the valve element 41. In the present structure, the outer circumferential periphery of the cylindrical portion 45 of the valve element 41 and the guide member 30 therebetween define the fuel communication channel 81.

The guide member 30 defines a cavity 34 at the inner circumferential periphery of the valve seat portion 32. The cavity 34 communicates with the introduction passage 111 through the communicating portion 151, which is defined by the inner circumferential periphery of the cylindrical portion 15 of the housing body 11. The cavity 34 of the guide member 30, the communicating portion 151 of the housing body 11, and the introduction passage 111 define a fluid passage. In the present structure, the valve element 41 and the guide member 30 therebetween define the fuel communication channel 81, which is located on the radially outside of the valve element 41. The fuel communication channel 81 communicates the inlet passage 112, which communicates with the compression chamber 113, with the fluid passage, which includes the cavity 34, the communicating portion 151, and the introduction passage 111.

The bottom portion 44 of the valve element 41 has a surface on the opposite side of the compression chamber 113, and the surface of the bottom portion 44 is configured to make contact with the valve seat portion 32 of the guide member 30. When the bottom portion 44 of the valve element 41 makes contact with the valve seat portion 32, the fuel communication channel 81 is isolated from the cavity 34, which is a part of the fluid passage. When the bottom portion 44 of the valve element 41 is lifted from the valve seat portion 32, the fuel communication channel 81 is communicated with the cavity 34, which is a part of the fluid passage.

The stopper 42 is substantially in a plate shape and is fixed to the guide member 30. The stopper 42 is provided farther away than the valve element 41 with respect to the valve seat portion 32 of the guide member 30. The stopper 42 is configured to make contact with the opening end 49 of the valve element 41, which is located on the opposite side of the valve seat portion 32, to regulate movement of the valve element 41. When the stopper 42 is in contact with the valve element 41, the stopper 42 closes an opening of the cylindrical portion 45 on the opposite side of the bottom portion 44. In the present structure, when the stopper 42 is in contact with the valve element 41, collision of fuel flowing from the compression chamber 113 against the bottom portion 44 can be moderated.

The spring 43 is provided inside the valve element 41, which is substantially in a cylindrical shape. The spring 43 is in contact with the stopper 42 at one end. The spring 43 is in contact with the bottom portion 44 of the valve element 41 at the other end. The spring 43 is axially extendable. The spring 43 biases the valve element 41 toward the valve seat portion 32.

The solenoid actuator 50 includes a coil 51, a stationary core 52, a movable core 53, a magnetic member 54, a flange 55, a spring 56 as a first biasing member, and a needle 57. The coil 51 is wound around a spool 58, which is formed from resin, and configured to generate a magnetic field when being energized. The stationary core 52 is formed from a magnetic material. The stationary core 52 is accommodated radially inside of the coil 51 and the magnetic member 54. The movable core 53 is formed from a magnetic material. The movable core 53 is opposed to the stationary core 52. The movable core 53 is axially movable inside an inner circumferential periphery of a cylinder member 59, which is formed from a non-magnetic material. The cylinder member 59 accommodates the movable core 53 and restricts a short circuit of a magnetic path between the stationary core 52 and the flange 55. The spring 56 is provided between the stationary core 52 and the movable core 53. The spring 56 biases the movable core 53 away from the stationary core 52. The spring 56 exerts biasing force to bias the movable core 53, and the biasing force of the spring 56 is greater than the biasing force of the spring 43, which biases the valve element 41. When the coil 51 is not energized, the stationary core 52 and the movable core 53 are apart from each other.

The flange 55 is formed from a magnetic material. The flange 55 is attached to the cylindrical portion 15 of the housing body 11. In the present structure, the flange 55 closes the end of the cylindrical portion 15 and retains the solenoid actuator 50 on the housing body 11. The magnetic member 54 surrounds the outer circumferential periphery of the coil 51. The magnetic member 54 is formed from a magnetic material to magnetically conduct the stationary core 52 with the flange 55. The flange 55 has a communication hole 61. The communication hole 61 maintains the communicating portion 151 and an exterior outside the flange 55 at equivalent pressure.

The needle 57 is integrated with the movable core 53. The needle 57 is configured to make contact with the valve element 41 at an end portion on the opposite side of the movable core 53. The biasing force of the spring 56 is greater than the biasing force of the spring 43. Therefore, when the coil 51 is not energized, the needle 57, which is integrated with the movable core 53, is moved toward the valve element 41 and lifted from the valve seat portion 32 of the guide member 30 by being biased from the spring 56. The coil 51 of the solenoid actuator 50, the stationary core 52, the movable core 53, the magnetic member 54, the flange 55, the spool 58, and the cylinder member 59 construct a coil portion.

As follows, an operation of the high-pressure fuel pump 10 is described.

(1) Suction Stroke

When the plunger 13 moves downward in FIG. 2, energization of the coil 51 is terminated. Therefore, the valve element 41 moves toward the compression chamber 113 by being biased from the spring 56 of the solenoid actuator 50 via the valve element 41, the needle 57, and the movable core 53. Consequently, the valve element 41 is lifted from the valve seat portion 32 of the guide member 30. As the plunger 13 moves downward in FIG. 2, the compression chamber 113 decreases in pressure. In this case, force exerted to the valve element 41 from fuel in the cavity 34 becomes larger than force exerted to the valve element 41 from fuel in the compression chamber 113. The valve element 41 is exerted with force and lifted from the valve seat portion 32. The valve element 41 keeps moving until the cylindrical portion 45 makes contact with the stopper 42 at the end portion on the opposite side of the bottom portion 44. When the valve element 41 is lifted from the valve seat portion 32, the fuel chamber 16 is communicated with the compression chamber 113 through the introduction passage 111, the communicating portion 151, the cavity 341 the fuel communication channel 81, and the inlet passage 112. Thus, fuel is drawn from the fuel chamber 16 into the compression chamber 113. In the present condition, the valve element 41 is in contact with the stopper 42, whereby the stopper 42 closes the opening of the opening end 49, which is farther away from the bottom portion 44 than the cylindrical portion 45.

(2) Return Stroke

When the plunger 13 moves upward from the bottom dead center toward the top dead center, pressure of fuel in the compression chamber 113 increases, whereby force is exerted from fuel in the compression chamber 113 to the valve element 41 in a direction in which the valve element 41 is seated to the valve seat portion 32. When the coil 51 is not energized, the needle 57 is projected toward the compression chamber 113 beyond the valve seat portion 32 by being applied with biasing force of the spring 56. In the present condition, movement of the valve element 41 is regulated by the needle 57.

The valve element 41 is closed by the stopper 42 at the opening end 49 on the opposite side of the bottom portion 44. Therefore, collision of fuel flowing from the compression chamber 113 against the bottom portion 44 can be moderated.

In the present operation, the valve element 41 keeps being lifted from the valve seat portion 32 in the period where the coil 51 is de-energized. The plunger 13 moves upward to pressurize fuel in the compression chamber 113, and the fuel is partially returned from the compression chamber 113 to the fuel chamber 16 through the inlet passage 112, the fuel communication channel 81, the cavity 34, the communicating portion 151, and the introduction passage 111, contrary to the case where fuel is drawn from the fuel chamber 16 into the compression chamber 113.

(3) Press-Feed Stroke

The coil 51 is energized at a midway point of the return stroke to generate a magnetic field, hereby forming a magnetic circuit in the stationary core 52, the magnetic member 54, the flange 55, and the movable core 53. Thus, the stationary core 52 and the movable core 53, which are apart from each other, generate magnetic attractive force therebetween. When the magnetic attractive force between the stationary core 52 and the movable core 53 becomes greater than the biasing force of the spring 56, the movable core 53 moves toward the stationary core 52. In this condition, the needle 57, which is integrated with the movable core 53, also moves toward the stationary core 52. When the needle 57 moves toward the stationary core 52, the valve element 41 is spaced from the needle 57, and the valve element 41 does not receive force from the needle 57. In this condition, the valve element 41 is moved toward the valve seat portion 32 by being applied with the biasing force of the spring 43.

The valve element 41 moves toward the valve seat portion 32, and the valve element 41 is seated to the valve seat portion 32, so that the fuel communication channel 81 is isolated from the cavity 34. Thus, the return stroke of fuel from the compression chamber 113 to the fuel chamber 16 is terminated. Fuel returned from the compression chamber 113 to the fuel chamber 16 is controlled by closing the passage between the compression chamber 113 and the fuel chamber 16 in the period where the plunger 13 moves upward. Thus, the amount of fuel further pressurized in the compression chamber 113 is determined.

The plunger 13 further moves toward the top dead center in the condition where the passage between the compression chamber 113 and the fuel chamber 16 is closed, thereby further increasing pressure of fuel in the compression chamber 113. When pressure of fuel in the compression chamber 113 becomes equal to or greater than predetermine pressure, the ball member 73 moves against the force exerted to the ball member 73 from the biasing force applied from the spring 74 in the delivery valve portion 70 and the force exerted from the downstream of the valve seat 75. Thus, the ball member 73 is lifted from the valve seat 75. Thus, the delivery valve portion 70 opens, so that fuel pressurized in the compression chamber 113 is led through the discharge passage 114 and discharged from the high-pressure fuel pump 10. The fuel discharged from the high-pressure fuel pump 10 is accumulated in the delivery pipe (not shown) to be supplied to the injector. In the present condition, the needle 57 is spaced from the valve element 41. Therefore, even when the valve element 41 receives force from fuel in the compression chamber 113, the force is not transmitted to the needle 57 of the solenoid actuator 50.

When the plunger 13 moves upward and reaches the top dead center, the plunger 13 again starts moving downward in FIG. 2. Thus, pressure of fuel in the compression chamber 113 decreases, and the coil 51 is de-energized. The valve element 41 again moves away from the valve seat portion 32, whereby fuel is drawn from the fuel chamber 16 into the compression chamber 113.

The coil 51 may be de-energized when pressure in the compression chamber 113 increases to predetermined pressure. As pressure of fuel in the compression chamber 113 increases, the force, which is exerted to the valve element 41 to seat the valve element 41 to the valve seat portion 32, becomes greater than the force, which is exerted to the valve element 41 to lift the valve element 41 from the valve seat portion 32. Therefore, even when the coil 51 is de-energized, the valve element 41 keeps being seated to the valve seat portion 32 by being exerted with force from fuel in the compression chamber 113. Thus, power consumption of the solenoid actuator 50 can be reduced by de-energizing the coil 51 at a predetermined time point.

The high-pressure fuel pump 10 pumps fuel by repeating the suction stroke, the return stroke, and the press-feed stroke. The metering valve portion 40 controls the amount of fuel discharged from the high-pressure fuel pump 10 by controlling the timing of supplying electricity to the coil 51 of the metering valve portion 40.

According to the present embodiment, the substantially cylindrical valve element 41 is closed by the stopper 42 at the opening end 49. That is, the stopper 42 closes the opening of the opening end 49 of the cylindrical portion 45 on the opposite side of the bottom portion 44. In the present structure, the valve element 41 makes contact with the stopper 42 to be restricted in movement when the valve element 41 is spaced from the valve seat portion 32. The cylindrical portion 45 of the valve element 41 is closed by the stopper 42 at the opening end 49 on the opposite side of the bottom portion 44. Therefore, when fuel is returned from the compression chamber 113 to the fuel chamber 16 in the return stroke, fuel, which is increased in pressure in the compression chamber 113, is restricted from flowing into the cylindrical portion 45 through the opening on the opposite side of the bottom portion 44. Thus, when fuel flows from the compression chamber 113, collision of the fuel against the bottom portion 44 can be moderated, so that the valve element 41 can be restricted from being urged toward the valve seat portion 32 by being biased from the fuel flow in the return stroke. Consequently, the biasing force of the spring 56, which biases the valve element 41 via the needle 57 in order to keep the valve element 41 lifted from the valve seat portion 32, can be reduced. Therefore, the spring 56 can be restricted from increasing in size. In addition, increasing in size of the solenoid actuator 50 caused by upsizing of the spring 56 can be restricted. Consequently, the solenoid actuator 50 can be reduced in size. Energy consumption of the solenoid actuator 50 can be also reduced.

Second Embodiment

Figure 3:
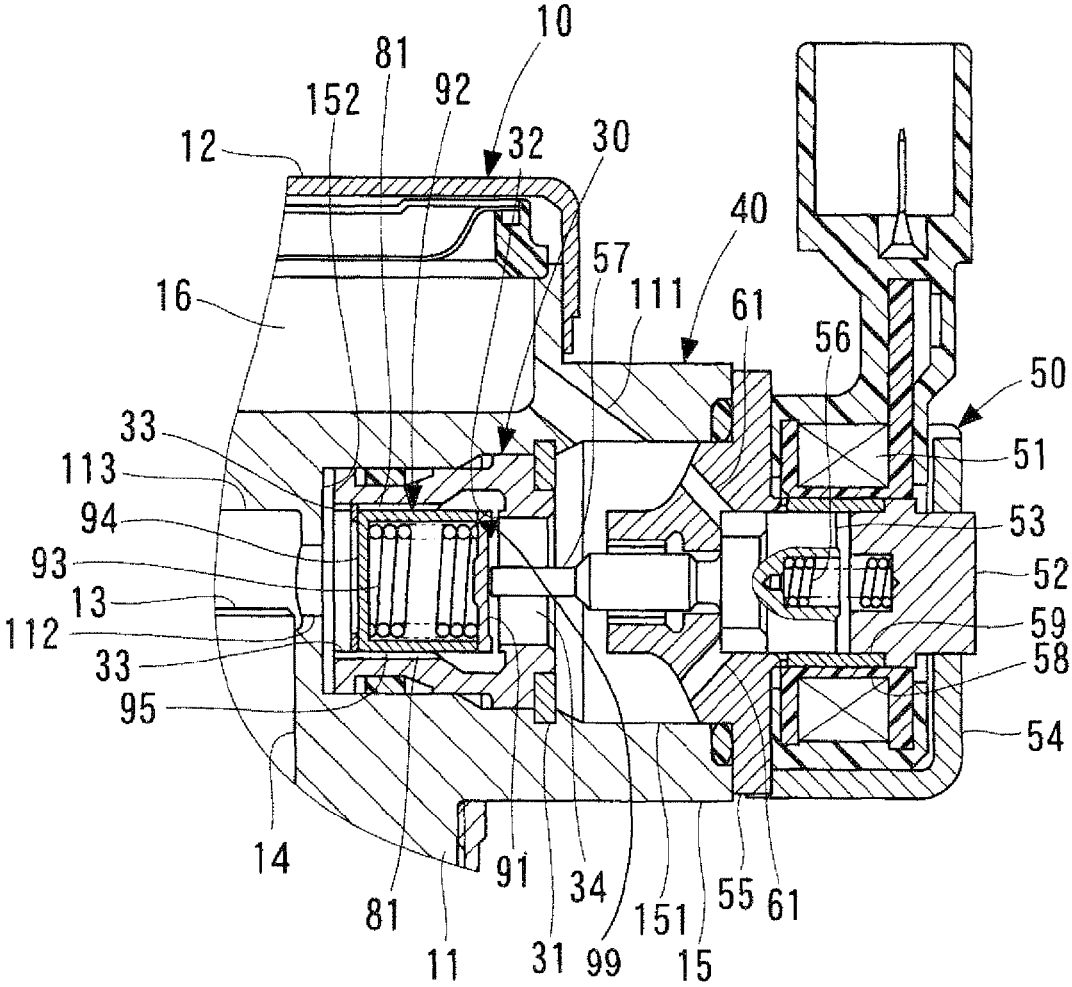
FIG. 3 is a sectional view showing the housing accommodating a metering valve portion according to a second embodiment.

As shown in FIG. 3, in the second embodiment, the valve element and the stopper are different from those in the first embodiment. As shown in FIG. 3, in the present embodiment, a valve element 91 is substantially in a plate shape. A stopper 92 is a closed-end cylindrical member including a bottom portion 94, a cylindrical portion 95, and an opening end 99. The end of the stopper 92 on the side of the compression chamber 113 defines the bottom portion 94. The cylindrical portion 95 is configured to make contact with the valve element 91 at the opening end 99 on the opposite side of the bottom portion 94. When the valve element 91 is lifted from the valve seat portion 32, and the valve element 91 makes contact with the cylindrical portion 95 of the stopper 92, the valve element 91 is regulated in movement. The outer diameter of the stopper 92 is smaller than the inner diameter of the guide member 30. In the present structure, the outer circumferential periphery of the cylindrical portion 95 of the stopper 92 defines the fuel communication channel 81. The valve element 91 is axially guided by the guide member 30. The spring 93 is in contact with the valve element 91 at one axial end. The spring 93 is in contact with the bottom portion 94 of the stopper 92 at the other axial end.

According to the present embodiment, the stopper 92 is closed by the bottom portion 94 at the opening end 99 on the side of the compression chamber 113. Therefore, when fuel is pressurized in the compression chamber 113 and returned from the compression chamber 113 into the fuel chamber 16 in the return stroke, collision of the returned fuel against the bottom portion 44 can be moderated. Consequently, the valve element 91 can be restricted from being biased from the fuel flow and urged toward the valve seat portion 32 in the return stroke. Thus, the biasing force of the spring 56, which biases the valve element 91 via the needle 57 in order to keep the valve element 91 lifted from the valve seat portion 32, can be reduced. Therefore, the spring 56 can be restricted from increasing in size. In addition, increasing in size of the solenoid actuator 50 caused by upsizing of the spring 56 can be also restricted. Consequently, the solenoid actuator 50 can be reduced in size. Energy consumption of the solenoid actuator 50 can be also reduced.

Furthermore, as compared with the first embodiment, the valve element 91 as a movable component is downsized in the present embodiment. Thus, the valve element 91 can be reduced in weight. Consequently, manipulation force required for the valve element 91 can be reduced, so that the solenoid actuator 50 can be reduced in size and energy consumption. In addition, valve element can be enhanced in response.

Third Embodiment

Figure 4A:
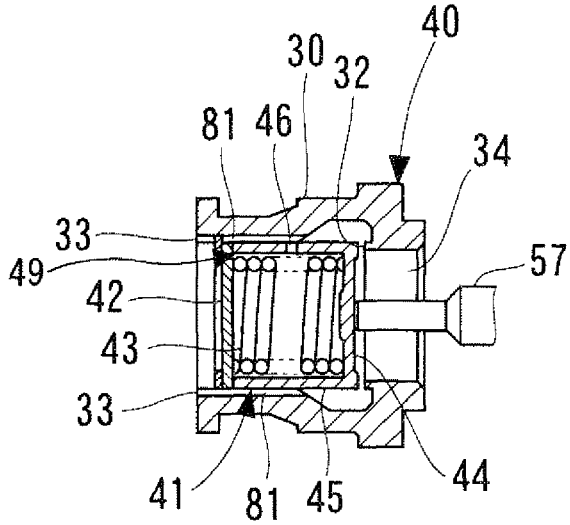
FIGS. 4A to 4C are sectional views each showing a metering valve portion of the hydraulic pump, according to a third embodiment.
Figure 4B:
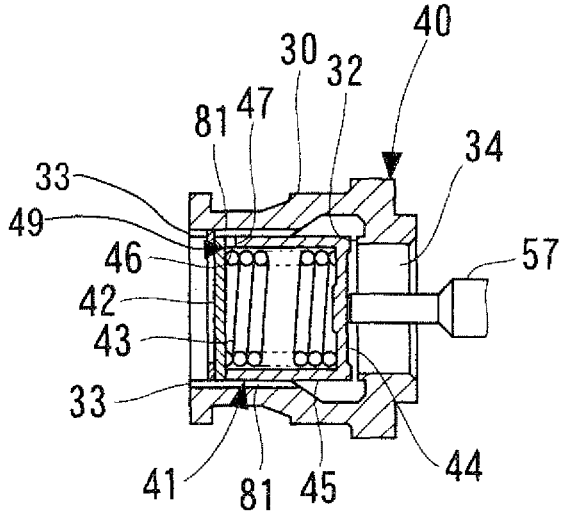
Figure 4C:
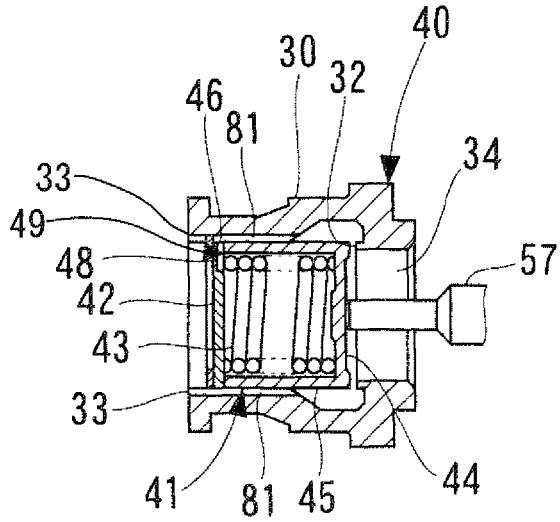

As shown in FIGS. 4A, 4B, 4C, the present embodiment is a modification of the first embodiment. As described in the first embodiment, when the valve element 41 is lifted from the valve seat portion 32, the stopper 42 closes the opening end 49 of the valve element 41 on the opposite side of the bottom portion 44. Therefore, fuel returned from the compression chamber 113 can be restricted from colliding against the bottom portion 44 of the valve element 41, so that the valve element 41 can be restricted from being biased from the returned fuel flow toward the valve seat portion 32.

Here, in the return stroke, fuel discharged from the compression chamber 113 flows around the valve element 41. Therefore, pressure of fuel in the fuel communication channel 81 becomes higher as compared with pressure of fuel inside the valve element 41. In the present condition where pressure of fuel outside the valve element 41 is higher than pressure of fuel inside the valve element 41, movement of the valve element 41 may be delayed when being lifted from the stopper 42. Thus, the valve element 41 cannot be promptly seated to the valve seat portion 32 when the needle 57 is attracted by the solenoid actuator 50, since the movement of the valve element 41 being lifted from the stopper 42 is delayed. Consequently, a metering performance of fuel is impaired.

Therefore, in the present structure, a communication passage 46 is provided to communicate an exterior of the valve element 41 with an interior of the valve element 41. As shown in FIG. 4A, the valve element 41 of the metering valve portion 40 has the communication passage 46, which radially extends through the cylindrical portion 45. As shown in FIG. 4B, the cylindrical portion 45 has a groove 47 at the opening end 49 on the side of the stopper 42 to define the communication passage 46 between the cylindrical portion 45 and the stopper 42 in the metering valve portion 40. As shown in FIG. 4C, the stopper 42 has a groove 48 at the end portion on the side of the cylindrical portion 45 to define the communication passage 46 between the cylindrical portion 45 and the stopper 42 in the metering valve portion 40.

In the present structure, the communication passage 46 is provided to communicate an exterior of the valve element 41 with an interior of the valve element 41 to equalize pressure therebetween. In addition, the communication passage 46 extends in the radial direction of the valve element 41. Therefore, even when fuel flows from the outside of the valve element 41 into the valve element 41, collision of fuel flow against the bottom portion 44 of the valve element 41 is moderated, thereby the fuel flow can be restricted from biasing the valve element 41 toward the valve seat portion 32. Thus, quick manipulation of the valve element 41 is enabled, and the solenoid actuator 50 can be restricted from being increased in size.

Fourth Embodiment

Figure 5A:
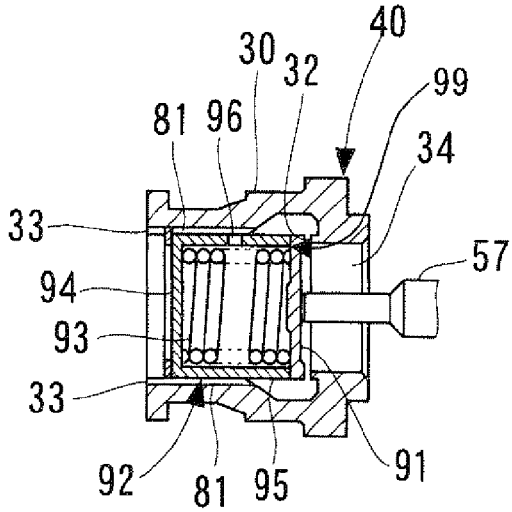
FIGS. 5A to 5C are sectional views each showing a metering valve portion of the hydraulic pump, according to a fourth embodiment.
Figure 5B:
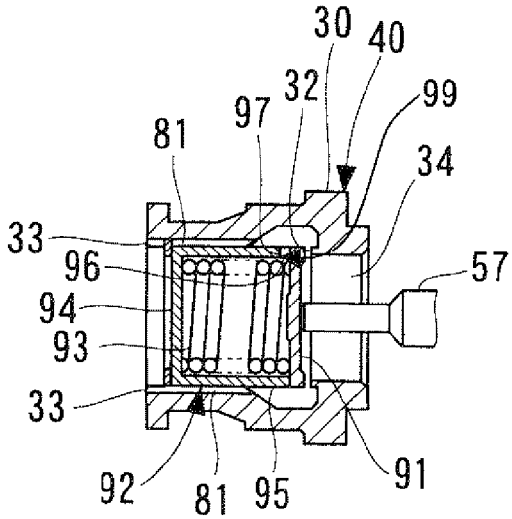
Figure 5C:
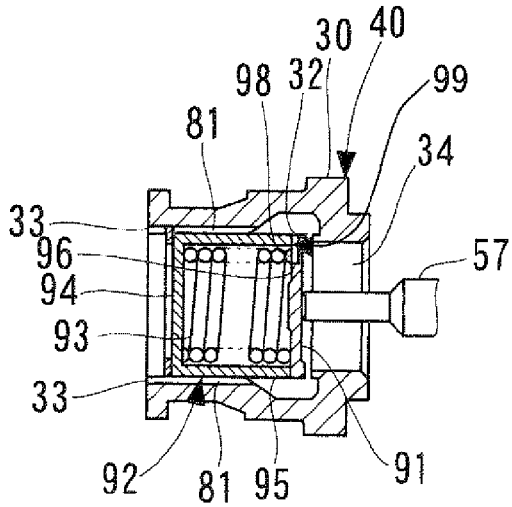

As shown in FIGS. 5A, 5B, 5C, the present embodiment is a modification of the second embodiment. As described in the second embodiment, the valve element 91 is lifted from the valve seat portion 32, so that the valve element 91 makes contact with the cylindrical portion 95 of the stopper 92. Therefore, fuel returned from the compression chamber 113 can be restricted from colliding against the valve element 91, so that the valve element 91 can be restricted from being biased from the fuel flow toward the valve seat portion 32.

Furthermore, as described in the third embodiment, pressure difference occurs between an exterior of the stopper 92 and an interior of the stopper 92 in the return stroke. Therefore, in the present structure, a communication passage 96 is provided to communicate an exterior of the stopper 92 with an interior of the stopper 92. As shown in FIG. 5A, the metering valve portion 40 includes the stopper 92 having the communication passage 96, which radially extends through the cylindrical portion 95. As shown in FIG. 5B, the cylindrical portion 95 has a groove 97 at the opening end 99 on the side of the valve element 91 to define the communication passage 96 between the cylindrical portion 95 and the valve element 91 in the metering valve portion 40. As shown in FIG. 5C, the valve element 91 has a groove 98 at the end portion on the side of the cylindrical portion 95 to define the communication passage 96 between the cylindrical portion 95 and the valve element 91 in the metering valve portion 40.

In the present structure, the communication passage 96 is provided to communicate the exterior of the stopper 92 with the interior of the stopper 92 to equalize pressure therebetween. In addition, the communication passage 96 extends in the radial direction of the stopper 92. Therefore, even when fuel flows from the outside of the stopper 92 into the stopper 92, collision of fuel flow against the valve element 91 is moderated, thereby the fuel flow can be restricted from biasing the valve element 91 toward the valve seat portion 32. Thus, quick manipulation of the valve element 91 is enabled, and the solenoid actuator 50 can be restricted from being increased in size.

Fifth Embodiment

Figure 6A:
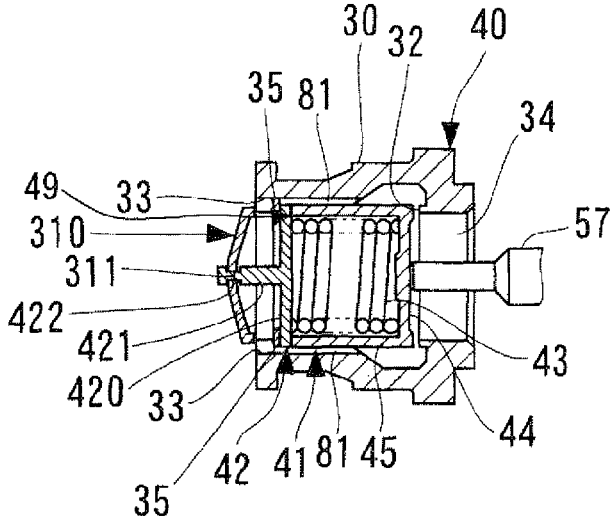
FIGS. 6A to 6C are sectional views each showing a metering valve portion of the hydraulic pump, according to a fifth embodiment.
Figure 6B:
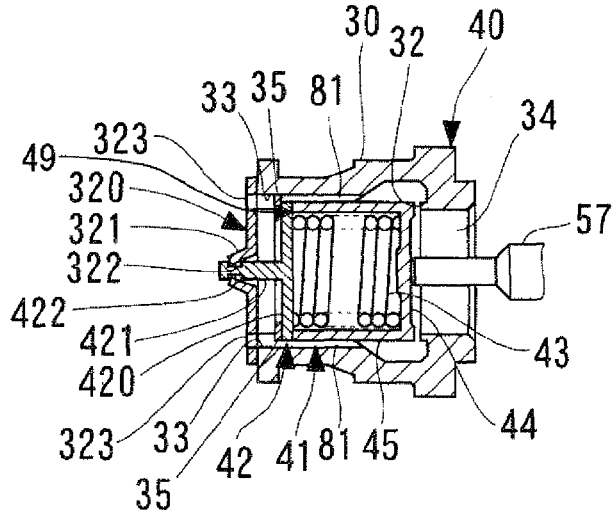
Figure 6C:
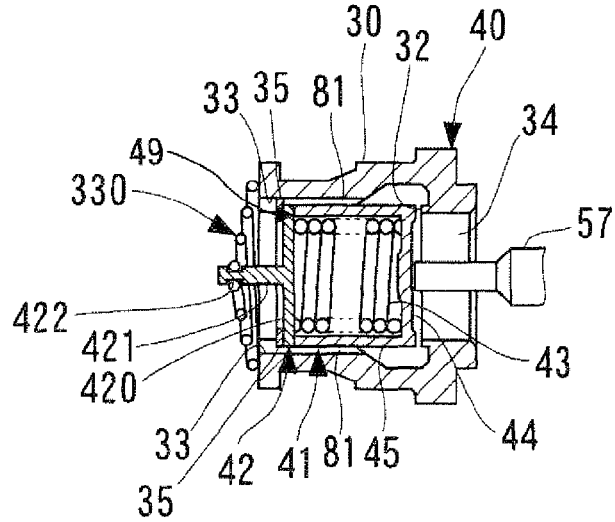

As shown in FIGS. 6A, 6B, 6C, the present embodiment is a modification of the first embodiment. As described in the first embodiment, the valve element 41 is lifted from the valve seat portion 32, so that the stopper 42 closes the opening end 49 of the valve element 41 on the opposite side of the bottom portion 44. Therefore, fuel returned from the compression chamber 113 can be restricted from colliding against the bottom portion 44 of the valve element 41, so that the valve element 41 can be restricted from being biased from the fuel flow toward the valve seat portion 32.

Here, in the return stroke, the end surface of the stopper 42 on the opposite side of the valve element 41 is exerted with force from the returned fuel toward the valve element 41. In the present condition, the stopper 42 may be displaced against the biasing force of the spring 56 and moved toward the valve element 41, since the stopper 42 receives the force toward the valve element 41. When the stopper 42 moves toward the valve element 41, an axial movable range of the valve element 41 is reduced correspondingly to the displacement of the stopper 42. Consequently the movable range as the lift of the valve element 41 is reduced, and the performance of the valve element 41 is impaired.

Figure 7A:
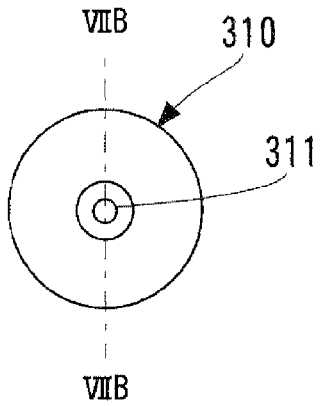
FIG. 7A is a front view showing a biasing member of the metering valve portion.
Figure 7B:
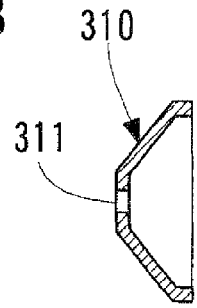
FIG. 7B is a sectional view taken along the line VIIB-VIIB in FIG. 7A.
Figure 7C:
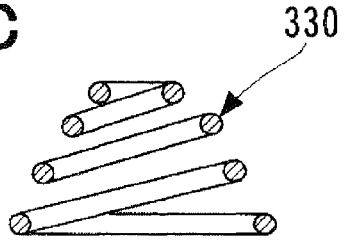
FIG. 7C is a sectional view showing a biasing member of the metering valve portion.

According to the present embodiment, a second biasing member is provided to the stopper 42. The second biasing member is located farther away from the valve element 41 than the stopper 42 to bias the stopper 42 to the opposite side of the valve element 41. As shown in FIG. 6A, a biasing member 310 is provided farther away from the valve element 41 than the stopper 42 in the metering valve portion 40. The biasing member 310 is formed from a resilient material such as metal or resin. As shown in FIGS. 7A, 7B, the biasing member 310 is substantially in a disc shape, which protrudes in center. As shown in FIG. 7B, the biasing member 310 is substantially in a conical shape axially protruding to one side. The biasing member 310 has an opening 311, which is substantially in a circular shape and axially extending through a center portion of the biasing member 310.

The stopper 42 includes a stopper body 420 and a projection 421. The stopper body 420 is substantially in a disc shape. Referring to FIG. 6A, the projection 421 protrudes from a radial center of the stopper body 420 in a direction opposite to the valve element 41. The projection 421 is substantially in a circular column shape. The projection 421 has an axially intermediate portion defining a groove portion 422. The groove portion 422 is substantially in an annular shape and circumferentially extends along an outer wall of the projection 421. The groove portion 422 is reduced in outer diameter in the projection 421. The outer diameter of the projection 421 other than the groove portion 422 is larger than an inner diameter of the opening 311 of the biasing member 310

A suspending member 35 as a first suspending member is fixed to the inner wall of the guide member 30 on the opposite side of the valve seat portion 32. The suspending member 35 extends along the inner wall of the guide member 30. Part of the outer wall of the suspending member 35 and part of the inner wall of the guide member 30 therebetween define the fuel communication channel 81. In the present structure, the fuel communication channel 81 is configured to communicate fuel flow, so that the suspending member 35 may not disturb the fuel flow. The suspending member 35 has an end on the side of the valve element 41, and the end of the suspending member 35 is in contact with a circumferential end periphery of the end of the stopper body 420 on the opposite side of the valve element 41.

The biasing member 310 and the valve element 41 are located on opposite sides of the stopper 42. The biasing member 310 has one end on the opposite side of the protruding center thereof, and the end of the biasing member 310 is in contact with an end of the guide member 30 on the opposite side of the valve seat portion 32. An outer diameter of the end of the biasing member 310 on the side of the valve element 41 is smaller than an inner diameter of the guide member 30 at the groove 33. In the present structure, the biasing member 310 may not block the fuel communication channel 81 defined by the groove 33. Thus, communication between the compression chamber 113 and the fluid passage can be secured.

An inner diameter of the opening 311 of the biasing member 310 is smaller than an outer diameter of the projection 421 of the stopper 42. The inner diameter of the opening 311 of the biasing member 310 is substantially the same or slightly larger than an outer diameter of the groove portion 422 of the projection 421. In the present structure, the projection 421 of the stopper 42 is inserted into the opening 311 of the biasing member 310, whereby the biasing member 310 can be fitted to the groove portion 422 of the projection 421 at the opening 311. Thus, the protruding center of the biasing member 310 can be fixed to the groove portion 422 of the projection 421 at the opening 311.

The biasing member 310 is configured as a coned disc spring and has resilience to axially extend and protrude at the radial center thereof. The biasing member 310 has the end on the side of the valve element 41, and the end of the biasing member 310 is in contact with the end of the guide member 30, the end of the guide member 30 being on the opposite side of the valve seat portion 32. In addition, the biasing member 310 has the protruding center on the opposite side of the valve element 41, and the protruding center is fixed to the groove portion 422 of the projection 421. In the present structure, the biasing member 310 biases the stopper 42 in a direction opposite to the valve element 41. Therefore, the stopper body 420 is urged onto the end of the suspending member 35 at the circumferential end periphery thereof the circumferential end periphery being on the opposite side of the valve element 41. Thus, the stopper 42 is suspended by the suspending member 35.

According to the present embodiment, the biasing member 310 and the valve element 41 are located on opposite sides of the stopper 42. The biasing member 310 biases the stopper 42 in the direction opposite to the valve element 41, thereby suspending the stopper 42 to the suspending member 35. Therefore, even when the stopper 42 is biased toward the valve element 41 by receiving force from fuel, which is returned from the compression chamber 113 to the fluid passage, the stopper 42 can be restricted from moving toward the valve element 41. In the present structure, the movable range as the lift of the valve element 41 can be sufficiently secured. Therefore, the performance of the valve element 41 can be maintained.

In the present structure, the stopper 42 is restricted from moving toward the valve element 41 when fuel is returned from the compression chamber 113 to the fluid passage. Therefore, force exerted from the returned fuel to the valve element 41 via the stopper 42 can be reduced. Consequently the biasing force of the spring 56, which biases the valve element 41 via the needle 57 in order to keep the valve element 41 lifted from the valve seat portion 32, can be also reduced. According to the present embodiment, the end of the valve element 41 is closed by the stopper 42, similarly to the first embodiment. Therefore, force exerted from the returned fuel to the valve element 41 can be reduced. Thus, the biasing force, which is required to the spring 56 of the solenoid actuator 50 in order to keep the valve element 41 lifted from the valve seat portion 32, can be further reduced. Therefore, the spring 56 can be restricted from increasing in size. In addition, increasing in size of the solenoid actuator 50 caused by upsizing of the spring 56 can be also restricted.

As shown in FIG. 6B, a biasing member 320, which is provided instead of the biasing member 310, is substantially in a disc shape. The biasing member 320 is formed from a resilient material such as metal or resin, similarly to the biasing member 310. The biasing member 320 has a projected portion 321 substantially at a radial center thereof, and the projected portion 321 projects in a direction opposite to the valve element 41. The biasing member 320 has an opening 322, which axially extends through the projected portion 321 of the biasing member 320 substantially at the radial center thereof.

An outer diameter of the biasing member 320 is larger than an inner diameter of the guide member 30 at the groove 33. The biasing member 320 has a circumferential end periphery on the side of the valve element 41, and the circumferential end periphery of the biasing member 320 is in contact with the end of the guide member 30, the end of the guide member 30 being on the opposite side of the valve seat portion 32. The biasing member 320 has multiple communication holes 323 each axially extending through the biasing member 320. The multiple communication holes 323 are located correspondingly to positions of the groove 33 of the guide member 30. The communication holes 323 communicate with the fuel communication channel 81, which includes the groove 33 and the inlet passage 112. The inlet passage 112 communicates with the compression chamber 113. Thus, communication between the compression chamber 113 and the fluid passage can be secured.

An inner diameter of the opening 322 of the biasing member 320 is smaller than the outer diameter of the projection 421 of the stopper 42. An inner diameter of the opening 322 of the biasing member 320 is substantially the same or slightly larger than the outer diameter of the groove portion 422 of the projection 421. In the present structure, the projection 421 of the stopper 42 is inserted into the opening 322 of the biasing member 320, whereby the biasing member 320 can be fitted to the groove portion 422 of the projection 421 at the opening 322. Thus, the biasing member 320 can be fixed to the groove portion 422 of the projection 421 at the opening 322 of the protruding center on the opposite side of the valve element 41.

The biasing member 320 is configured as a coned disc spring and has resilience to axially extend and protrude at the radial center thereof, similarly to the biasing member 310 shown in FIG. 6A. The biasing member 320 has the end on the side of the valve element 41, and the end of the biasing member 320 is in contact with the end of the guide member 30, the end of the guide member 30 being on the opposite side of the valve seat portion 32. In addition, the biasing member 320 has the protruding center on the opposite side of the valve element 41, and the protruding center is fixed to the groove portion 422 of the projection 421. In the present structure, the biasing member 320 biases the stopper 42 in a direction opposite to the valve element 41. Therefore, the stopper body 420 is urged onto the end of the suspending member 35 at the circumferential end periphery thereof, the circumferential end periphery being on the opposite side of the valve element 41. Thus, the stopper 42 is suspended by the suspending member 35. Therefore, even when the stopper 42 is biased toward the valve element 41 by receiving force from fuel, which is returned from the compression chamber 113 to the fluid passage, the stopper 42 can be restricted from moving toward the valve element 41.

Thus, according to the present embodiment, even in the structure in which the biasing member 310 is replaced to the biasing member 320, the movable range as the lift of the valve element 41 can be sufficiently secured, whereby the performance of the valve element 41 can be maintained, similarly to the structure including the biasing member 310. In addition, biasing force required to the spring 56 of the solenoid actuator 50 can be reduced, so that the spring 56 and the solenoid actuator 50 can be restricted from being increased in size.

In the structure shown in FIG. 6C, the biasing member 310 is replaced to a biasing member 330. The biasing member 330 is a coil spring formed from a resilient material such as metal or resin. The biasing member 330 has resilience to axially extend. The biasing member 330 has the end on the side of the valve element 41, and the end of the biasing member 330 is in contact with the end of the guide member 30, the end of the guide member 30 being on the opposite side of the valve seat portion 32. In addition, the biasing member 330 has a protruding center on the opposite side of the valve element 41, and the protruding center is fixed to the groove portion 422 of the projection 421. In the present structure, the stopper 42 is biased in a direction opposite to the valve element 41, thereby being suspended by the suspending member 35. Thus, even in the structure where the biasing member 330 is provided instead of the biasing member 310, a similar effect to the biasing member 310 can be produced.

Figure 7D:
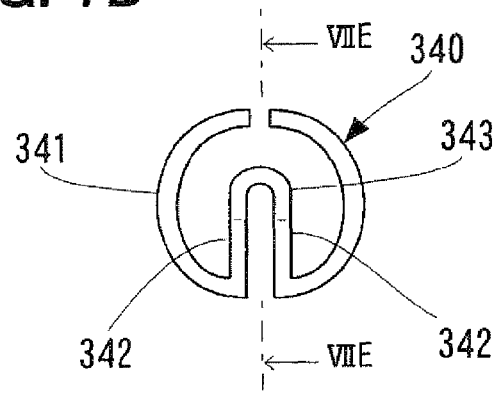
FIG. 7D is a front view showing a biasing member of the metering valve portion.
Figure 7E:
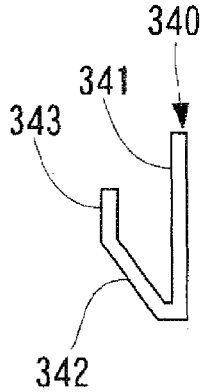
FIG. 7E is a sectional view taken along the line VIIE-VIIE in FIG. 7D.

According to the present embodiment, the biasing member 310 may be replaced to a biasing member 340 shown in FIGS. 7D, 7E. The biasing member 340 is formed from a resilient material such as metal or resin. The biasing member 340 includes a main body 341, an arm portion 342, and a holding portion 343. The main body 341 is substantially in an annular shape. The arm portion 342 extends from a part of a circumferential periphery of the main body 341. The arm portion 342 is inclined with respect to an axis of the main body 341. The arm portion 342 has an end on the opposite side of the main body 341, and the end of the arm portion 342 is connected with the holding portion 343.

In the present structure, the main body 341 of the biasing member 340 is in contact with the end of the guide member 30 on the opposite side of the valve seat portion 32. The holding portion 343 is fixed to the groove portion 422 of the projection 421 of the stopper 42. The biasing member 340 has resilience to axially extend. That is, the holding portion 343 of the biasing member 340 is exerted with force to be spaced from the main body 341. In the present structure, the stopper 42 is biased in a direction opposite to the valve element 41. Thus, the stopper 42 is suspended by the suspending member 35. Therefore, even in the structure where the biasing member 340 is provided instead of the biasing member 310, a similar effect to the biasing member 310 can be produced.

Figure 7F:
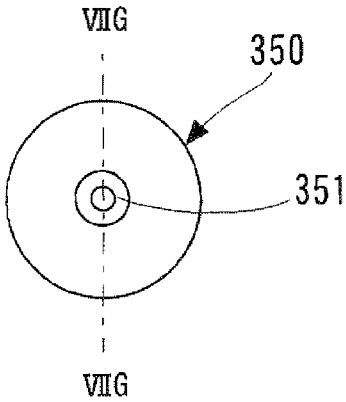
FIG. 7F is a front view showing a biasing member of the metering valve portion.
Figure 7G:
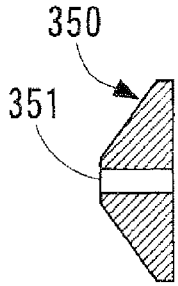
FIG. 7G is a sectional view taken along the line VIIG-VIIG in FIG. 7F, FIGS. 8A to 8D are sectional views each showing a metering valve portion of the hydraulic pump, according to a sixth embodiment.

The biasing member 310 may be replaced to a biasing member 350 shown in FIGS. 7F, 7G. The biasing member 350 is formed from an elastic material such resin or rubber. The biasing member 350 is substantially in a shape of a triangular pyramid. The biasing member 350 has an opening 351, which axially extends through the biasing member 350. The biasing member 350 has resilience to axially extend. In the present structure, the biasing member 350 retains the stopper 42 on the suspending member 35 by biasing the stopper 42 in a direction opposite to the valve element 41. Therefore, even in the structure where the biasing member 350 is provided instead of the biasing member 310, a similar effect to the biasing member 310 can be produced.

According to the present embodiment, the biasing member 310 may be in any shape as long as being configured to bias the stopper 42 in the direction opposite to the valve element 41. According to the present embodiment, at least one of the valve element 41 and the stopper 42 may have the communication passage 46 similarly to the third embodiment. In this case the metering valve portion 40 is capable of producing effects similarly to the third embodiment.

Sixth Embodiment

As shown in FIGS. 8A to 8D, the present embodiment is a modification of the fifth embodiment. According to the present embodiment, similarly to the fifth embodiment, the valve element 41 is lifted from the valve seat portion 32, so that the stopper 42 closes the opening end 49 of the valve element 41 on the opposite side of the bottom portion 44. Therefore, fuel returned from the compression chamber 113 can be restricted from colliding against the bottom portion 44 of the valve element 41, so that the valve element 41 can be restricted from being biased from the fuel flow toward the valve seat portion 32.

Figure 8A:
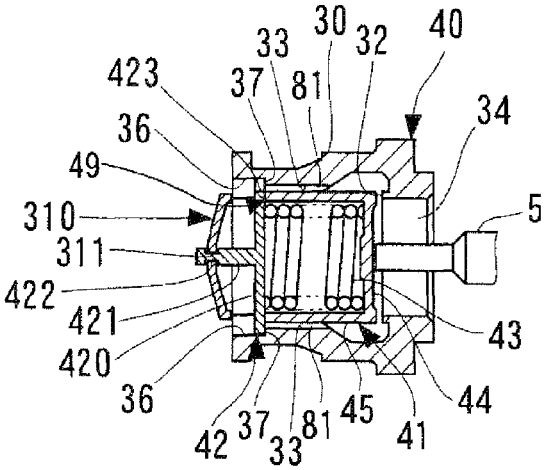

As shown in FIG. 8A, according to the present embodiment, the inner wall of the guide member 30 defines an enlarged diameter portion 36 on the opposite side of the valve seat portion 32. The enlarged diameter portion 36 of the guide member 30 has an inner diameter, which is larger than an inner diameter of the guide member 30 at the groove 33. In the present structure, the enlarged diameter portion 36 and the groove 33 therebetween define a step portion 37 along the inner wall of the guide member 30.

The stopper 42 is inserted into the inner circumferential periphery, which defines the enlarged diameter portion 36 of the guide member 30. An outer diameter of the stopper body 420 of the stopper 42 is substantially the same as or slightly smaller than the inner diameter of the enlarged diameter portion 36 of the guide member 30. An outer diameter of the stopper body 420 of the stopper 42 is larger than the inner diameter of the guide member 30 at the groove 33. In the present structure, the stopper 42 is inserted in the inner circumferential periphery of the enlarged diameter portion 36, and an outer circumferential end of the stopper body 420 of the stopper 42 on the side of the valve element 41 is in contact with the step portion 37. The outer circumferential end of the stopper body 420 has multiple communicating portions 423 correspondingly to the positions of the groove 33. Each communicating portion 423 communicates the fuel communication channel 81, which is defined by the groove 33, with a space defined by the stopper body 420 on the opposite side of the valve element 41.

The second biasing member in the present embodiment may be substantially identical to the second biasing member in the second embodiment. As shown in FIG. 8A, the biasing member 310 as the second biasing member is located on the opposite side of the valve seat portion 32 of the guide member 30. The end of the biasing member 330 on the side of the valve element 41 is fixed to the end of the guide member 30 on the opposite side of the valve seat portion 32 by welding or the like. That is, the biasing member 310 is fixed to the guide member 30.

The opening 311 of the biasing member 310 is fitted to the groove portion 422 of the projection 421 of the stopper 42, similarly to the fifth embodiment. In the present structure, the end of the biasing member 310 on the opposite side of the valve element 41 is fixed to the groove portion 422 of the projection 421. According to the present embodiment, the biasing member 310 has resilience to axially contract. In the present structure, the stopper 42 is biased from the biasing member 310 toward the valve element 41. In the present structure, the outer circumferential end of the stopper body 420 of the stopper 42 on the side of the valve element 41 is biased to the step portion 37 of the guide member 30. Thus, the stopper 42 is suspended on the step portion 37.

Figure 8B:
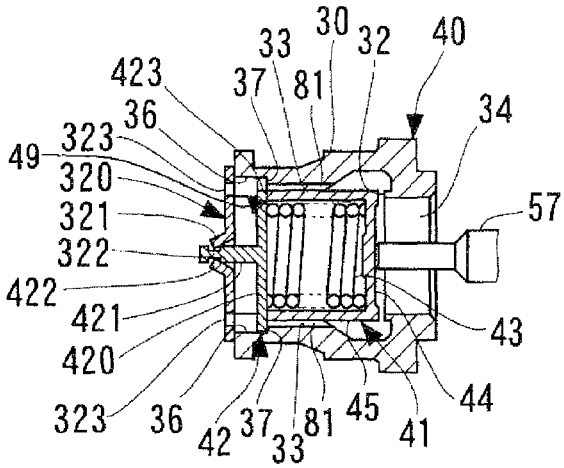
Figure 8C:
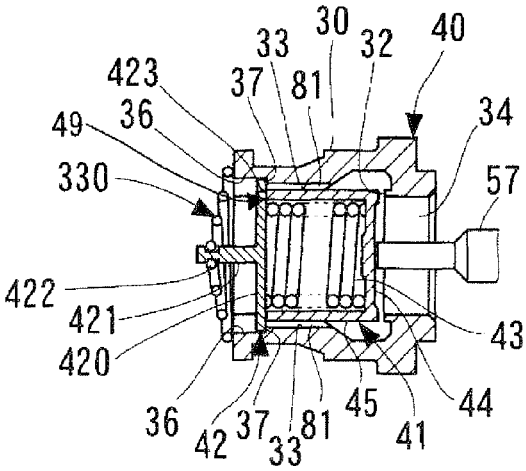

As shown in FIGS. 8B, 8C, according to the present embodiment, either of the biasing member 320, 330 may be provided instead of the biasing member 310, similarly to the fifth embodiment. In this case, the end of the either of the biasing member 320, 330 on the side of the valve element 41 is fixed to the end of the guide member 30 by welding or the like. In addition, the either of the biasing member 320, 330 has a protruding center on the opposite side of the valve element 41, and the protruding center is fixed to the groove portion 422 of the projection 421. According to the present embodiment, the either of the biasing member 320, 330 has resilience to axially contract. Therefore, the stopper 42 is biased toward the valve element 41, thereby being suspended on the step portion 37 of the guide member 30.

Figure 8D:
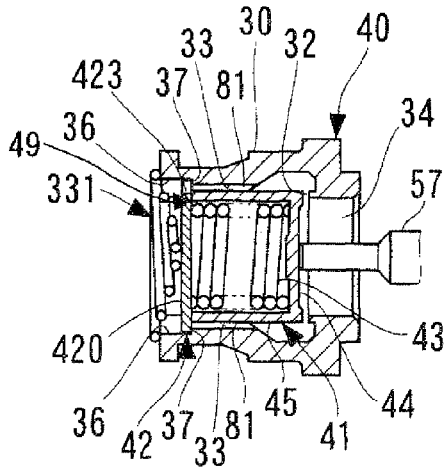

The metering valve portion 40 shown in FIG. 8D is a modification of the structure shown in FIG. 8C. In the metering valve portion 40 shown in FIG. 8D, the stopper 42 does not have the projection 421, that is, the stopper 42 includes only the stopper body 420. The biasing member 331 is farther away from the valve element 41 than the stopper 42. The outer circumferential end of the biasing member 331 is fixed to the end of the guide member 30 on the opposite side of the valve seat portion 32 by welding or the like. The center end of the biasing member 331 on the side of the valve element 41 is in contact with the end of the stopper body 420 of the stopper 42. The biasing member 331 has resilience to axially extend. Therefore, the stopper 42 is biased toward the valve element 41, thereby being suspended on the step portion 37 of the guide member 30.

According to the present embodiment, the biasing member and the valve element 41 are located on opposite sides of the stopper 42. The biasing member 310 biases the stopper 42 toward the valve element 41, thereby suspending the stopper 42 on the step portion 37 of the guide member 30. Therefore, even when the stopper 42 is biased toward the valve element 41 by receiving force from fuel, which is returned from the compression chamber 113 to the fluid passage, the stopper 42 can be restricted from moving toward the valve element 41. In the present structure, the movable range as the lift of the valve element 41 can be sufficiently secured. Therefore, the performance of the valve element 41 can be maintained, similarly to the fifth embodiment. Thus, according to the present embodiment, the biasing force, which is required to the spring 56 of the solenoid actuator 50 in order to keep the valve element 41 lifted from the valve seat portion 32, can be reduced similarly to the fifth embodiment. Therefore, the spring 56 can be restricted from increasing in size. In addition, increasing in size of the solenoid actuator 50 caused by upsizing of the spring 56 can be also restricted.

According to the present embodiment, the biasing member 310 may be in any shape as long as being configured to bias the stopper 42 toward the valve element 41. At least one of the valve element 41 and the stopper 42 may have the communication passage 46 similarly to the third embodiment. In this case, the metering valve portion 40 is capable of producing effects similarly to the third embodiment.

Seventh Embodiment

Figure 9:
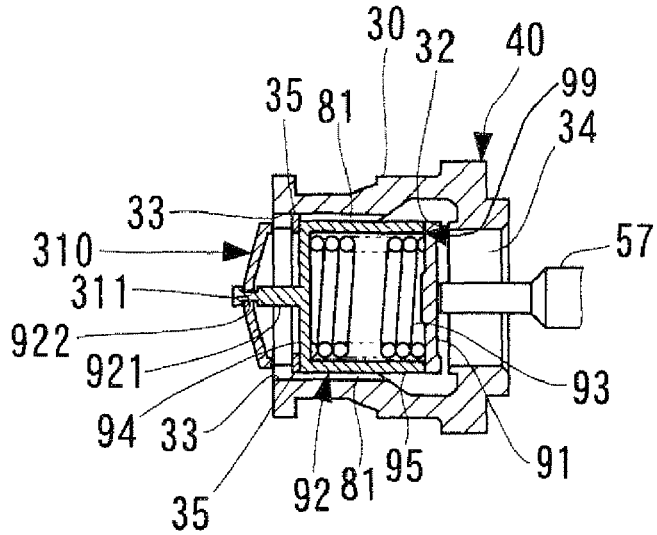
FIG. 9 is a sectional view showing a metering valve portion of the hydraulic pump, according to a seventh embodiment.

As shown in FIG. 9, the structure in the present embodiment is produced by combining the second and the fifth embodiments. The shape of the valve element is equivalent to that in the second embodiment. The shape of the stopper is different from that in the second embodiment. According to the present embodiment, the stopper 92 is a bottomed cylindrical member including the bottom portion 94 and the cylindrical portion 95, similarly to the second embodiment. The bottom portion 94 of the stopper 92 has a projection 921 on the opposite side of the valve element 91, similarly to the stopper 42 in the fifth embodiment. The projection 921 is projected substantially from a center of the bottom portion 94 on the opposite side of the valve element 91. The projection 921 has an axially intermediate portion defining the groove portion 422.

According to the present embodiment, the biasing member 310 is provided farther away from the valve element 91 than the stopper 42, similarly to the fifth embodiment. The biasing member 310 has the end on the side of the valve element 91, and the end of the biasing member 330 is in contact with the end of the guide member 30, the end of the guide member 30 being on the opposite side of the valve seat portion 32. In addition, the biasing member 310 has the opening 311 on the opposite side of the valve element 91, and the opening 311 is fixed to a groove portion 922 of the projection 921. The biasing member 310 has resilience to axially extend. In the present structure, the biasing member 310 biases the stopper 92 in a direction opposite to the valve element 41. Thus, the stopper 92 is suspended by the suspending member 35, similarly to the fifth embodiment. In this case, the metering valve portion 40 is capable of producing effects similarly to the fifth embodiment.

According to the present embodiment, the biasing member 310 may be replaced to any one of the biasing member 320, 330, 340, 350 shown in FIGS. 6B, 6C, 7D to 7G, similarly to the fifth embodiment. The biasing member 310 may be in any shape as long as being configured to bias the stopper 92 in a direction opposite to the valve element 91.

According to the present embodiment, at least one of the valve element 91 and the stopper 92 may have the communication passage 96 similarly to the fourth embodiment. In this case, the metering valve portion 40 is capable of producing effects similarly to the fourth embodiment.

Eighth Embodiment

Figure 10:
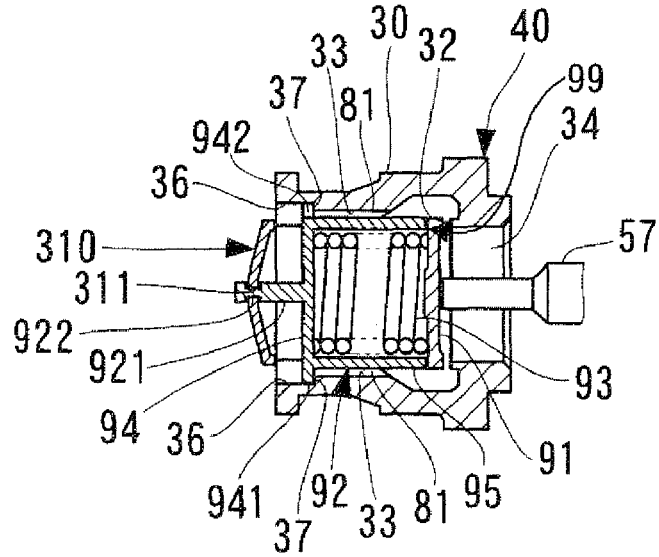
FIG. 10 is a sectional view showing a metering valve portion of the hydraulic pump, according to an eighth embodiment.

As shown in FIG. 10, the structure in the present embodiment is produced by combining the second and the sixth embodiments. According to the present embodiment, the outer diameter of the bottom portion 94 of the stopper 92 is larger than the outer diameter of the cylindrical portion 95. In the present structure, the bottom portion 94 of the stopper 92 has a collar portion 941, which extends radially outward from the cylindrical portion 95. An end surface of the collar portion 941 on the side of the valve element 91 is in contact with the step portion 37 of the guide member 30.

According to the present embodiment, the end of the biasing member 310 on the side of the valve element 91 is fixed to the guide member 30 by welding or the like, similarly to the fifth embodiment. The opening 311 of the biasing member 310 is fixed to the groove portion 922 of the projection 921 of the stopper 92. The biasing member 310 has resilience to axially contract. Therefore, the stopper 92 is biased toward the valve element 91, so that the collar portion 941 of the stopper 92 is biased to the step portion 37 of the guide member 30. Thus, the stopper 92 is suspended by the step portion 37. In this case, the metering valve portion 40 is capable of producing effects similarly to the sixth embodiment.

The collar portion 941 has a communication portion 942 correspondingly to the position of each fuel communication channel 81. The communication portion 942 communicates a space, which is defined by the collar portion 941 on the side of the valve element 91, with a space defined by the collar portion 941 on the opposite side of the valve element 91. In the present structure, the collar portion 941 may not disturb the fuel flow.

According to the present embodiment, the biasing member 310 may be replaced to any one of the biasing member 320, 330, 331, 340, 350 shown in FIGS. 8B, 8C, 8D, 7D to 7G, similarly to the sixth embodiment. The biasing member may be in any shape as long as being configured to bias the stopper 92 toward the valve element 91. At least one of the valve element 91 and the stopper 92 may have the communication passage 96 similarly to the fourth embodiment.

Ninth Embodiment

Figure 11:
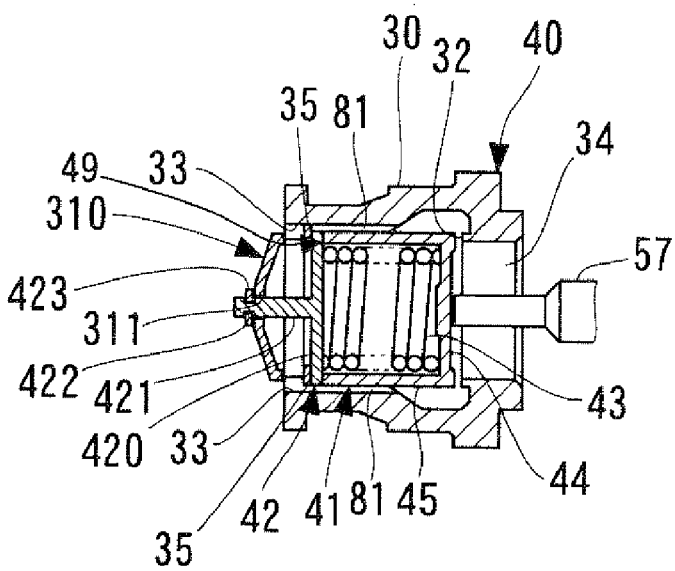
FIG. 11 is a sectional view showing a metering valve portion of the hydraulic pump, according to a ninth embodiment.

As shown in FIG. 11, the present embodiment is a modification of the fifth embodiment. According to the present embodiment, the opening 311 of the biasing member 310 is located closer to the valve element 41 than the groove portion 422 of the projection 421. The inner diameter of the opening 311 is substantially the same or slightly larger than the outer diameter of the projection 421. A suspending member 423 as a second suspending member is fitted to the groove portion 422 of the projection 421. The suspending member 423 is substantially in an annular shape and larger than the projection 421 in outer diameter. The biasing member 310 has resilience to axially extend.

The groove portion 422 is located farther away from the valve element 41 than the opening 311 of the biasing member 310. The suspending member 423 is fitted to the groove portion 422. In the present structure, the biasing member 310 is suspended by the suspending member 423, thereby being regulated in movement in a direction opposite to the valve element 41. In the present structure, the biasing member 310 can be restricted from being detached from the stopper 42 in a direction opposite to the valve element 41. Thus, the biasing member 310 maintains biasing of the stopper 42 in a direction opposite to the valve element 41. Whereby, the stopper 42 can be further steadily maintained at the predetermined position. The suspending member 423 may be applied to the structure in the seventh embodiment. In the seventh embodiment, the biasing member 310 can be also restricted from being detached from the stopper 92 by providing the suspending member 423.

Tenth Embodiment

Figure 12:
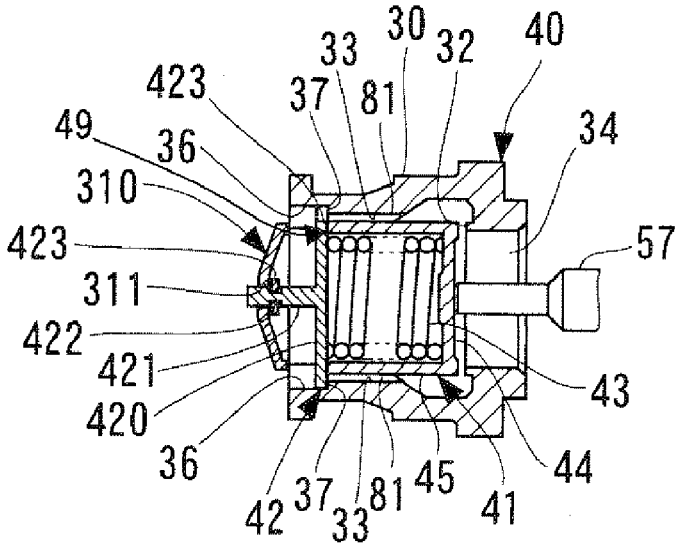
FIG. 12 is a sectional view showing a metering valve portion of the hydraulic pump, according to an tenth embodiment.

As shown in FIG. 12, the present embodiment is a modification of the sixth embodiment. According to the present embodiment, the end of the biasing member 310 on the side of the valve element 41 is fixed to the end of the guide member 30 by welding or the like, similarly to the sixth embodiment. The opening 311 of the biasing member 310 is located farther away from the valve element 41 than the groove portion 422 of the projection 421. The inner diameter of the opening 311 is substantially the same or slightly larger than the outer diameter of the projection 421. The suspending member 423 as a suspending member is fitted to the groove portion 422 of the projection 421. The suspending member 423 is substantially in an annular shape and larger than the projection 421 in outer diameter. The biasing member 310 is resilient to axially contract. The biasing member 310 has the end on the side of the valve element 41, and the end of the biasing member 330 is fixed to the end of the guide member 30, the end of the guide member 30 being on the opposite side of the valve seat portion 32.

The groove portion 422 is located closer to the valve element 41 than the opening 311 of the biasing member 310. The suspending member 423 is fitted to the groove portion 422. In the present structure, the biasing member 310 is suspended by the suspending member 423, thereby being regulated in movement in a direction toward the valve element 41. Thus, the biasing member 310 can be restricted from being displaced toward the valve element 41. Consequently, the biasing member 310 maintains biasing of the stopper 42 in a direction toward the valve element 41. Whereby, the stopper 42 can be further steadily maintained at the predetermined position. The suspending member 423 may be applied to the structure in the eighth embodiment. In the eighth embodiment, the biasing member 310 can be also restricted from being displaced toward the valve element 91 by providing the suspending member 423.

Eleventh Embodiment

Figure 13:
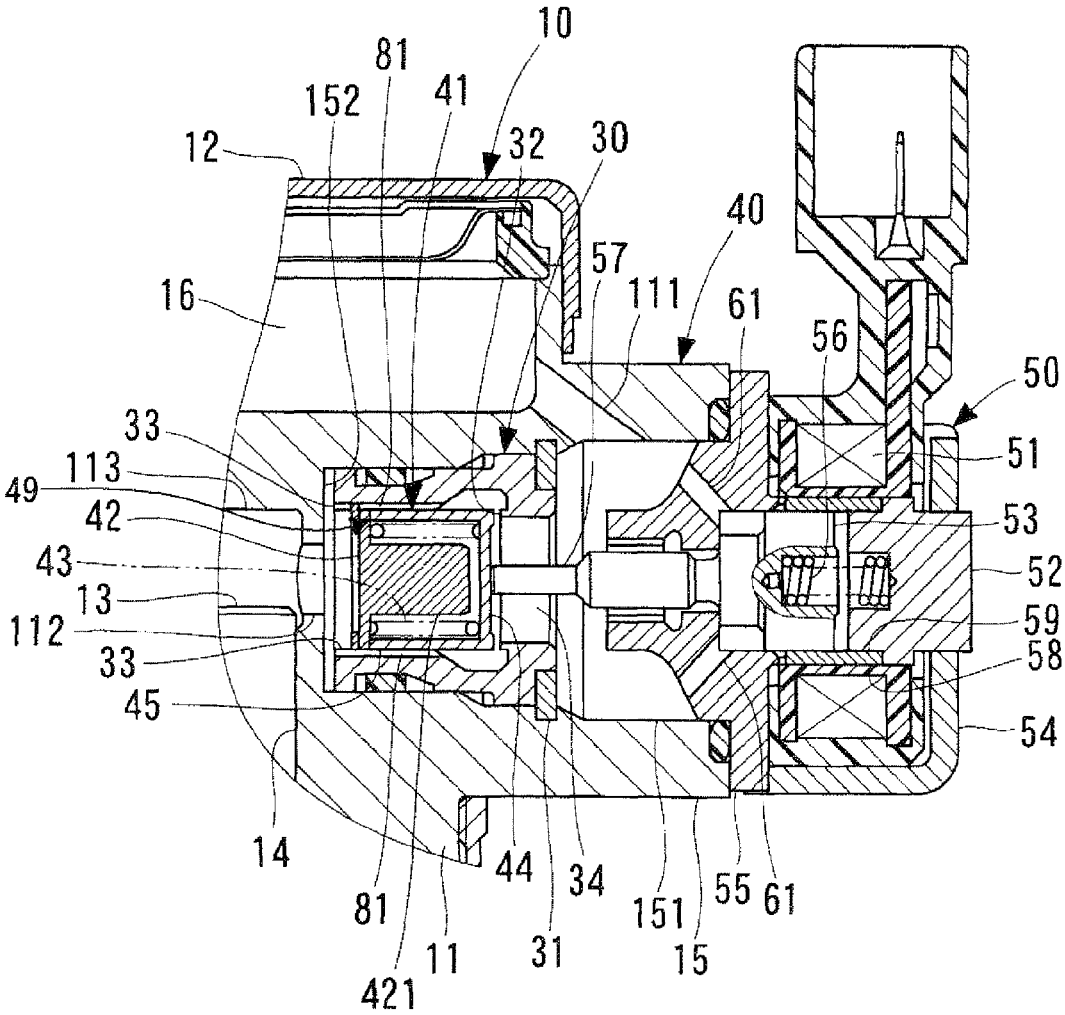
FIG. 13 is a sectional view showing the housing accommodating a metering valve portion according to an eleventh embodiment.
Figure 14:
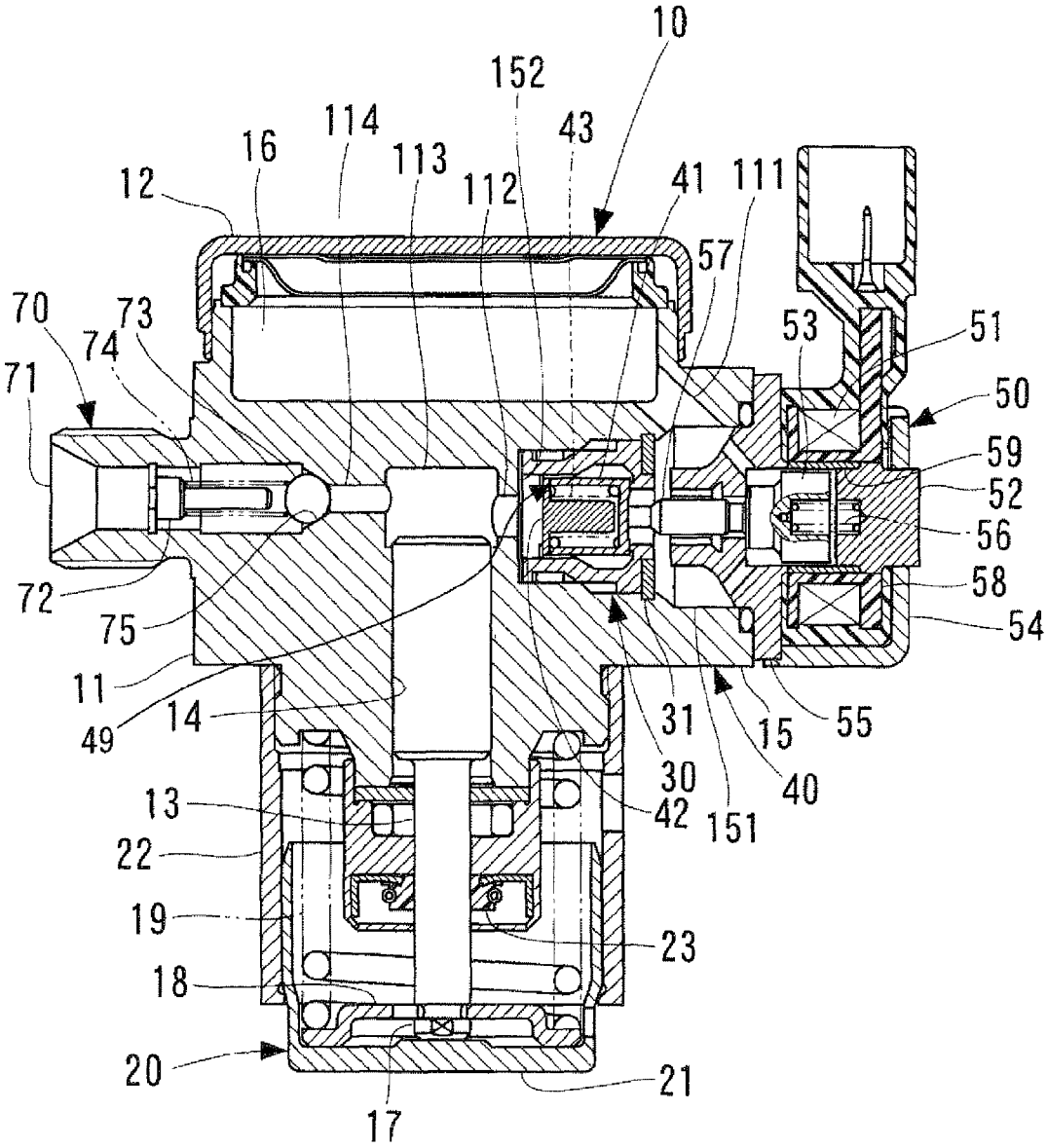
FIG. 14 is a sectional view showing the hydraulic pump according to the eleventh embodiment.

According to the present embodiment, as shown in FIGS. 13, 14, the stopper 42 has the projection 421, which projects toward the bottom portion 44 of the valve element 41 from an end surface of the stopper 42, the end surface of the stopper 42 being located on the side of the valve element 41. The protrusion 421 is, for example, integrally formed with the stopper 42. According to the present embodiment, the protrusion 421 is substantially a circular columnar member having an outer diameter being substantially in uniform with respect to an axial direction. The protrusion 421 provided to the stopper 42 is accommodated inside the cylindrical valve element 41. The cylindrical valve element 41 is a closed-end cylindrical member having the bottom portion 44. In the present structure, a space inside the valve element 41, which has the bottom portion 44, the cylindrical portion 45, and the opening end 49, is occupied, i.e. filled with the protrusion 421. Consequently the volume of the space inside the valve element 41 can be reduced by accommodating the protrusion 421, which is integrated with the stopper 42.

The spring 43 as the biasing member is provided inside the valve element 41, which is substantially in a cylindrical shape. The spring 43 is located radially between the protrusion 421 and the valve element 41. The spring 43 is located radially outside the protrusion 421. In the present structure, the protrusion 421 may not disturb extension and contraction of the spring 43.

According to the present embodiment, the space inside the valve element 41 is occupied with the protrusion 421, which projects from the stopper 42. Therefore, the inner space of the valve element 41, which is communicated with the compression chamber 113, can be reduced in volume. In the present structure, a total amount of fuel, which is pressurized by the plunger 13 in the compression chamber 113, can be reduced.

According to the present embodiment, as described above, the stopper 42 is provided with the protrusion 421, which projects into the valve element 41. The space inside the valve element 41 is occupied with the protrusion 421, which projects from the stopper 42. The inner space of the valve element 41 can be reduced in volume. Thus, the inner space of the valve element 41, which is communicated with the compression chamber 113, can be reduced in volume, so that the total amount of fuel, which is pressurized by the plunger 13 in the compression chamber 113, can be reduced. Consequently, efficiency of compression and pumping of fuel can be enhanced.

According to the present embodiment, the protrusion 421 is integrally formed with the stopper 42. Therefore, the valve element 41 need not be changed in shape or the like. In the present structure, the inner volume of the valve element 41 can be reduced without increasing in weight. Therefore, delay in response of the valve element 41, which is caused by increase in weight thereof, can be avoided. In addition, since weight of the valve element 41 does not increase, the manipulation force of the solenoid actuator 50 need not be increased. Therefore, efficiency of compression and pumping of fuel can be enhanced without increasing the solenoid actuator 50 in size.

Twelfth Embodiment

Figure 15:
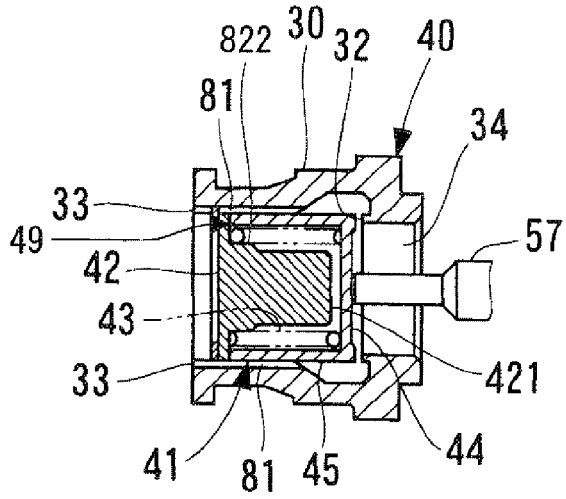
FIG. 15 is a sectional view showing a metering valve portion of the hydraulic pump, according to a twelfth embodiment.

According to the present embodiment, as shown in FIG. 15, the stopper 42, which is integrated with the protrusion 421, has a holding portion 822. The holding portion 822 is integrally formed with both the stopper 42 the protrusion 421. According to the present embodiment, the holding portion 822 is provided to an end of the protrusion 421 on the side of the stopper 42. The holding portion 822 is projected outward with respect to a radial direction of the protrusion 421. In the present structure, the holding portion 822 is larger in diameter than other portions of the protrusion 421. The outer diameter of the holding portion 822 is substantially the same or slightly smaller than the inner diameter of the spring 43. The spring 43 as a coil spring is fitted to the outer circumferential periphery of the holding portion 822. Thus, the spring 43 is held by the holding portion 822 at the end on the side of the stopper 42.

According to the present embodiment, the protrusion 421 is provided with the holding portion 822 for holding the end of the spring 43. In the present structure, the spring 43 can be restricted from being misaligned or deformed to cause buckling. Therefore, spring force of the spring 43 can be accurately produced and constantly maintained. According to the present embodiment, the holding portion 822 is provided to the end of the protrusion 421 on the side of the stopper 42. Alternatively, the holding portion 822 may be provided at any position with respect to the axial direction of the protrusion 421. Multiple holding portions 822 may be provided to the protrusion 421.

Thirteenth Embodiment

Figure 16:
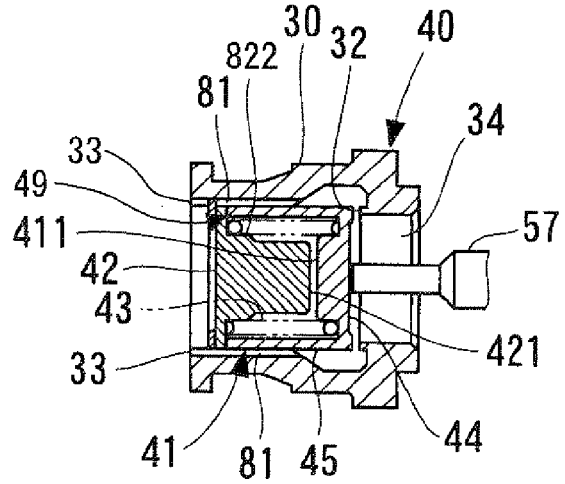
FIG. 16 is a sectional view showing a metering valve portion of the hydraulic pump, according to a thirteenth embodiment.

According to the present embodiment, as shown in FIG. 16, the valve element 41 has a protrusion 411, which projects toward the stopper 42. The protrusion 411 is located radially inside of the cylindrical portion 45 and projected from the bottom portion 44 of the valve element 41 toward the stopper 42. In the present structure, the volume of the space inside the valve element 41 can be further reduced. The protrusion 411 projects from the bottom portion 44 of the valve element 41 and may hold the end of the spring 43, the end of the spring 43 being located on the opposite side of the stopper 42. In the present structure, the spring 43 are supported by both the holding portion 822 and the protrusion 411 at both axial ends. Therefore, the present embodiment produces an effect to further steadily hold the spring 43, in addition to the effect produced in the twelfth embodiment. Thus, the spring 43 can be further restricted from being deformed.

Fourteenth Embodiment

Figure 17:
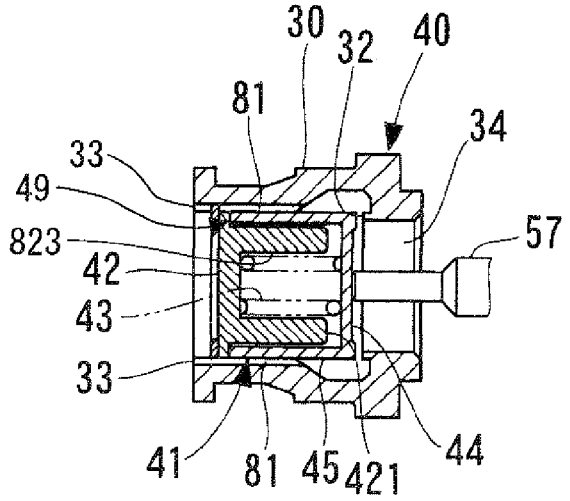
FIG. 17 is a sectional view showing a metering valve portion of the hydraulic pump, according to a fourteenth embodiment.

In the present embodiment, as shown in FIG. 17, the protrusion 421 is projected from the stopper 42, and the protrusion 421 is substantially in a cylindrical shape. The protrusion 421 therein has a cavity 823. According to the present embodiment, the spring 43 is provided radially inside of the cylindrical protrusion 421 and located in the cavity 823. In the present structure, the spring 43 can be retained in shape by the protrusion 421 from the radially outside. As described above, the spring 43 may be retained from the radially outside, in addition to being retained from the radially inside. According to the present embodiment, the volume radially inside of the valve element 41 can be reduced by providing the protrusion 421. In addition, the spring 43 can be retained from the radially outside, so that the spring 43 can be further protected from deformation.

Fifteenth Embodiment

Figure 18:
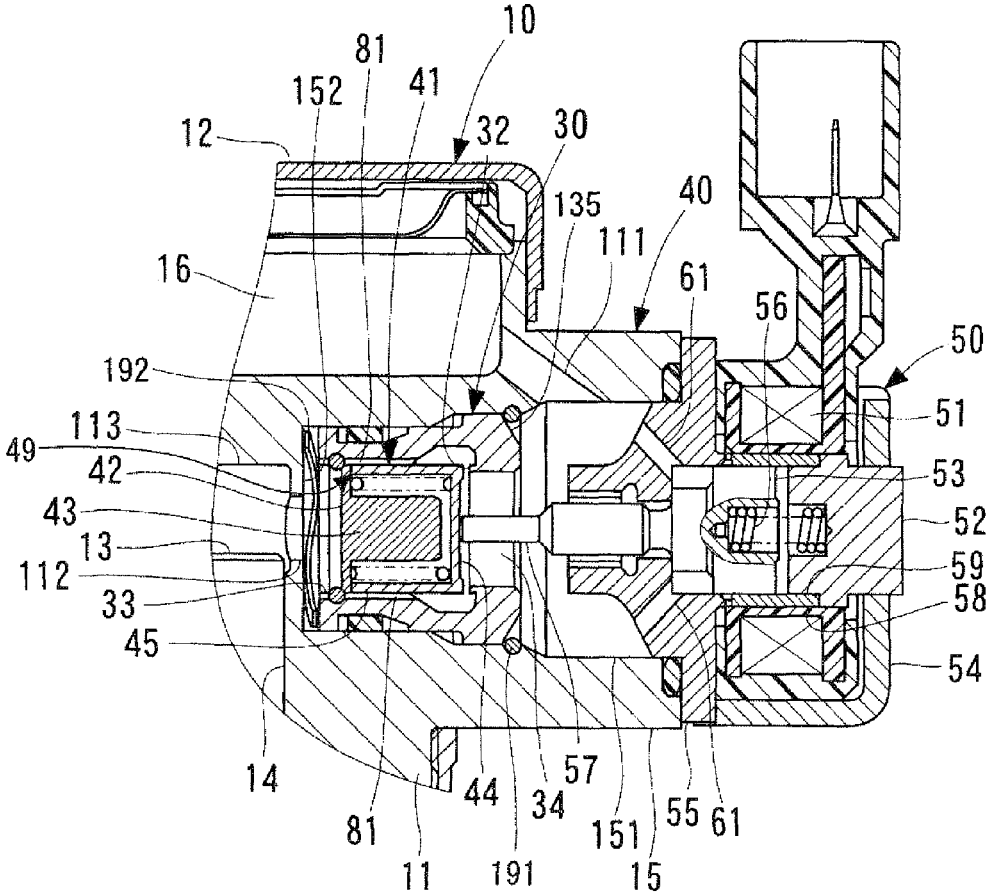
FIG. 18 is a sectional view showing the housing accommodating a metering valve portion according to a fifteenth embodiment.

According to the present embodiment, as shown in FIG. 18, the holding structure of the guide member 30 to the housing body 11 is different from those in the above embodiments. According to the present embodiment, the suspending member 31 is replaced to a ring member 191, and the guide member 30 is retained by the ring member 191 in the housing body 11. The ring member 191 is, for example, a C-ring substantially in the shape of C when being viewed from the front side. The ring member 191 is circumferentially discontinuous and radially resilient. The guide member 30 has an end on the opposite side of the compression chamber 113, and the end of the guide member 30 defines an inclined portion 135. The inclined portion 135 increases in outer diameter from an end close to the solenoid actuator 50 toward the compression chamber 113. The ring member 191 is provided between the inclined portion 135 and the housing body 11.

The ring member 191 is radially resilient. In the present structure, spring force of the ring member 191 increases correspondingly to deformation thereof, and the resilient force is exerted to the inclined portion 135 of the guide member 30. The spring force of the ring member 191 is exerted to the inclined portion 135 of the guide member 30, and the spring force has a component to bias the guide member 30 toward the compression chamber 113. In the present structure, the ring member 191 biases the guide member 30 toward the compression chamber 113. The guide member 30 has an end on the opposite side of the ring member 191, and the end of the guide member 30 is provided with a biasing member 192. The biasing member 192 is formed from an elastic material such resin or rubber. The biasing member 192 may be a coned disc spring. The biasing member 192 is located between the stepped surface 152 of the housing body 11 and the guide member 30. The biasing member 192 biases the guide member 30 in a direction opposite to the compression chamber 113, i.e., toward the solenoid actuator 50. In the present structure, the guide member 30 is interposed between the ring member 191 and the biasing member 192, thereby being retained at a position where the spring force of the ring member 191 and the biasing member 192 is balanced. According to the present embodiment, the guide member 30 is suspended to the housing body 11 by using both the ring member 191 and the biasing member 192. Therefore, the guide member 30 can be steadily secured to the housing body 11 in a simple structure.

Other Embodiments

According to the above embodiments, the guide member 30 is fixed inside the housing body 11. Alternatively, the guide member 30 may be omitted, and the housing body 11 may directly guide movement of the valve element 41, 91.

According to the thirteenth embodiment, the protrusion 411 is projected from the bottom portion 44 of the valve element 41 toward the stopper 42. Alternatively, for example, the protrusion 411 may be modified to a protrusion, which is projected radially inward from the inner circumferential periphery of the cylindrical portion 45 of the valve element 41. The shape of the protrusion 411 and the protrusion 421 are not limited to those in the above embodiments. The shape of the protrusion 411 and the protrusion 421 may be arbitrary determined.

In the eleventh to fifteenth embodiments described with reference to FIGS. 13 to 17, the valve element 41 may be a substantially plate-shaped member as described in the second embodiment with reference to FIG. 3, and the substantially plate-shaped valve element may have the protrusion. In this case, the stopper 42 may be a bottomed cylindrical member opposed to the valve element 41 to accommodate the protrusion.

The above structures of the embodiments may be arbitrary combined. For example, the components including the second biasing member described in the fifth to tenth embodiments with reference to FIGS. 6A to 12 may be combined with the protrusion of the stopper described in the eleventh to fourteenth embodiments with reference to FIGS. 13 to 17.

In the above embodiments, the hydraulic pump pumps fuel. However, the fluid pumped using the hydraulic pump is not limited to fuel. Various modifications and alternations may be diversely made to the above embodiments without departing from the spirit of the present invention.

What is claimed is:

1. A hydraulic pump comprising:

a housing having a compression chamber and a fluid passage;

a seat portion provided midway through the fluid passage;

a valve element located between the compression chamber and the fluid passage to control communication therebetween through a communication channel by being lifted from and seated to the seat portion, the valve element being substantially a plate-shaped member;

a solenoid actuator provided upstream of the valve element with respect to fluid flow for manipulating the valve element by lifting the valve element from the seat portion; and a stopper configured to make contact with an end of the valve element to regulate movement of the valve element in a direction opposite to the seat portion, wherein the communication channel is defined between the housing and an outer circumferential periphery of the stopper, the stopper is a closed-end cylindrical member having a bottom portion being closed to fluid, a cylindrical portion extending from an outer circumferential periphery of the bottom portion, and an opening end defined by the cylindrical portion, the bottom portion and the opening end being located at opposite axial ends of the cylindrical portion, the bottom portion being located farther away from the valve element than the cylindrical portion, and the opening end is configured to make contact with the end of the valve element.

2. The hydraulic pump according to claim 1, further comprising:

a resilient member accommodated in the stopper, wherein the resilient member is in contact with the bottom portion at one end and in contact with the valve element at an other end to bias the valve element toward the seat portion.

3. The hydraulic pump according to claim 1, wherein the solenoid actuator includes a needle, a first biasing member, and a coil, the first biasing member is configured to bias the valve element via the needle so as to lift the valve element from the seat portion, and the coil is configured to attract the needle in a direction opposite to the valve element.

4. The hydraulic pump according to claim 1, wherein the valve element has a communication passage configured to communicate the communication channel with an interior of the cylindrical portion.

5. The hydraulic pump according to claim 1, wherein the stopper has a communication passage configured to communicate the communication channel with an interior of the cylindrical portion.

6. The hydraulic pump according to claim 3, further comprising:

a first suspending member located farther away from the valve element than the stopper, the first suspending member being fixed to an inner wall of the housing; and a second biasing member located further away from the valve element than the stopper and configured to bias the stopper in a direction opposite to the valve element so as to suspend the stopper on the first suspending member.

7. The hydraulic pump according to claim 3, further comprising:

a second biasing member located further away from the valve element than the stopper, wherein the housing has an inner wall having a step portion located radially outside of the cylindrical portion, and the second biasing member is configured to bias the stopper toward the valve element so as to suspend the stopper on the step portion.

8. The hydraulic pump according to claim 6, further comprising:

a second suspending member located further away from the valve element than the stopper, wherein the second suspending member being configured to suspend an end portion of the second biasing member on an opposite side of the valve element.

9. The hydraulic pump according to claim 7, further comprising:

a suspending member located further away from the valve element than the stopper, wherein the suspending member is configured to suspend an end portion of the second biasing member on an opposite side of the valve element.

* * * * *